United States Patent [19]

Wiebe

[11] 4,205,431

[45] Jun. 3, 1980

[54] METHOD AND APPARATUS FOR MAKING A CYLINDRICAL END-CAPPED FUSE

[76] Inventor: Gerald L. Wiebe, 18 W. 077 Williamsburg La., Villa Park, Ill. 60181

[21] Appl. No.: 957,419

[22] Filed: Nov. 2, 1978

[51] Int. Cl.[2] ..... H01H 69/02; H01H 85/16

[52] U.S. Cl. ..... 29/623; 29/429; 29/756; 228/47; 228/180 R; 228/254; 264/251; 264/254

[58] Field of Search ..... 29/623, 429, 756; 264/254, 251, 138, 297; 228/47, 245, 254, 179, 180 R

[56] References Cited

U.S. PATENT DOCUMENTS

| | | | |
|---|---|---|---|
| 1,677,178 | 7/1928 | Fay | 29/429 |
| 2,621,369 | 12/1952 | Gantz | 264/251 |
| 3,247,355 | 4/1966 | Olsen | 228/47 |
| 3,624,886 | 12/1971 | Powers | 29/429 |
| 3,914,863 | 10/1975 | Wiebe | 29/623 |
| 4,152,798 | 5/1979 | Akaura | 264/251 |
| 4,157,486 | 6/1979 | Fegley | 29/623 |
| 4,159,458 | 6/1979 | Wiebe | 337/252 |

*Primary Examiner*—Francis S. Husar
*Assistant Examiner*—Gene P. Crosby

[57] ABSTRACT

A method and apparatus for making an encapsulated electrically conducting component is provided. A wire is placed across a mold cavity for forming substantially one-half of the component body. A substantially flat-surfaced second mold having a groove is placed against a first mold to hold the wire in the groove and in alignment with respect to the cavity of the first mold while fluid plastic material is injected therein to encapsulate a substantially semi-cylindrical surface portion of the wire and form one-half of the conducting component body. Next, a third mold is placed against the first mold. The third mold has a cavity defining substantially the remaining half of the component body. The fluid plastic is injected through the first mold and into the cavity in the third mold to form a completed, composite molded body. The body, with the wire projecting from each end, is taken from the mold and moved past a pair of spaced-apart anvils to bend the projecting wire portions inwardly towards the ends of the body. An end cap is aligned at each end of the body and both end caps are substantially simultaneously moved onto the body ends to force the projecting wire ends further against the respective body ends. Preferably, each end cap is treated, prior to being placed on the component body, by dropping a piece of solid solder into the end cap and then applying heat to the end cap by contacting the cap between a pair of spaced-apart electrodes and conducting electrical energy through the end cap to melt the solder. After such pre-soldered end caps have been placed on the component body ends, the end caps are preferably heated, as by contacting them with a resistance heating element, to remelt the solder to cause it to flow around the ends of the wire and provide a good electrical conducting path between the end cap and the ends of the wire.

34 Claims, 19 Drawing Figures

METHOD AND APPARATUS FOR MAKING A CYLINDRICAL END-CAPPED FUSE

CROSS REFERENCE TO RELATED APPLICATION

This application discloses subject matter that is related to the subject matter disclosed in my copending application Ser. No. 820,724 entitled "Encapsulated Electrically Conducting Component With Reservoir End Caps," filed Aug. 1, 1977, now Pat. No. 4,159,458.

BACKGROUND OF THE INVENTION

The present invention relates in general to electrically conducting components and more particularly to automotive and appliance type protective fuses which have a fusible link element encapsulated in a thermoplastic material. One such fuse is illustrated in the U.S. Pat. No. 3,914,863.

The present invention specifically includes an apparatus and method for making a fuse of the above-described type, and more particularly, to making the type of fuse described and illustrated in the above-referenced U.S. Pat. No. 4,159,458.

SUMMARY OF THE INVENTION

The present invention provides a method and apparatus for molding a thermoplastic body about a wire fuse link and for applying end caps to each end of the body.

The fuse is formed with a generally cylindrical, solid unitary body of thermoplastic material defining a body sidewall and oppositely facing body ends. An elongate wire-like fusible link formed from a low-melting point metal alloy is embedded in situ in the fuse body with opposite end portions of the fusible link extending outwardly beyond the end of the fuse body. Preferably, the novel method of the present invention for molding the fuse body is effected with a novel molding apparatus comprising a first mold and a vertically and horizontally reciprocable assembly of a first and second mold. The first mold has a plurality of cavities which form substantially one half of the body. The cavities are arranged in a plurality of parallel rows. A plurality of wires are arranged to be pulled from spools above the first mold and alongside the parting plane face of the first mold in front of the rows of cavities.

The third mold is fixed below the second mold and is movable therewith. The second mold has a plurality of grooves arranged in rows, which grooves are adapted to receive the wires hanging in front of the first mold. The third mold has a plurality of cavities which are adapted to form substantially one half of the fuse bodies.

The assembly of second and third molds is arranged so that the second mold, having the grooves, is arranged facing and opposite the first mode. The assembly is then moved towards the first mold so that the second mold abuts the first mold and so that the wires are received within the grooves in the second mold and are thus maintained essentially at the surface of the first mold. Thermoplastic material is injected through the rear of the first mold to fill the cavities therein and encapsulate about half the surface of the wire extending across each cavity. Next, the assembly of second and third molds is moved outwardly away from the first mold and then moved upwardly so that the third mold is aligned opposite the first mold. The third mold is then moved inwardly against the first mold and thermoplastic material is again injected through the rear of the first mold, through the thermoplastic material in the cavity of the first mold, and into the cavities of the second mold. After the thermoplastic material has cooled sufficiently, the third mold is moved outwardly away from the first mold carrying with it the thermoplastic material which is now in the form of a partially completed fuse. The assembly of the second and third molds is then moved downwardly to align the second mold with the first mold again. This action causes the wires to unreel past the now empty first mold cavities. The assembly of second and third molds is then moved to bring the second mold against the first mold with the new sections of wire received in the grooves of the second mold. Simultaneously, the third mold, containing the completed thermoplastic bodies, may be moved against a die beneath the first mold for severing the wires between the cavities and ejecting the molded bodies.

In another form of the method of molding the bodies, a rotating circular turntable may be used to carry the first mold in succession to a first station to receive the wires strung thereacross, in a second position to confront the second mold, to a third position to confront the third mold, and to a fourth position for confronting a trim die to sever the wires.

After the body has been molded, a metal end cap is positioned over each end portion of the body. The end portions of the wire-like fusible link elements are first positioned at an angle with respect to the length of the element within the body so as to be disposed adjacent the respective body ends. Preferably, each end cap has a cylindrical first portion and a cylindrical second portion with a diameter smaller than the first portion and joined to the first portion by an annular shoulder. The end cap further has an end wall at one end of the cylindrical second portion. The inside surface of the cylindrical first portion embraces the sidewall of the body adjacent one end thereof and the end wall of the end cap is disposed adjacent the end of the fuse body with the annular shoulder bearing against the fuse body end in a direct contact therewith whereby severance of the end portion of the wire-like fuse element by the end wall of the end cap is prevented by the annular shoulder which serves to maintain the end wall at a predetermined distance from the fuse body end.

The cylindrical second portion, in cooperation with the fuse body end, defines a chamber for receiving an electrically conducting material to improve the electrical conductance between the end cap and the wire-like fuse element.

According to the method of the present invention, an end cap is applied to the body of a component in a manner that effects good electrical contact betwen the end cap and a conductor end portion extending from the body. The method eliminates the need for a separate cleaning and/or fluxing of the conductor end portion before applying the end cap. Specifically, a liquid mixture of solder and flux is provided in the end cap chamber. Preferably the mixture is first deposited in the end cap as a solid piece of flux core solder and is then heated to form a liquid which coats the inside of the cap before cooling. The end cap is then applied to the component body end with the shoulder bearing against the body end and with the conductor end portion projecting into the chamber. Heat is applied to the end cap to remelt the mixture so that it flows around the conductor end portion to form a solder bond between the end portion and the end cap.

A novel apparatus is provided according to the present invention for applying the end caps to the molded component. Two anvil surfaces are provided at the spaced apart distance less than the distance between the distal ends of the outwardly extending conductor elements on each of the molded conducting components. The components are fed to a rotating holder which moves the component between the anvils and contacts the outwardly extending end portions of the conductor elements or wires on each end of each body to bend the end portions inwardly towards the respective body ends as the conducting component is carried past the anvils.

The rotating turntable then carries the component to an end cap applying station. At this point the end caps are applied, subtantially simultaneously to each end of the body of the component. Specifically, the end caps are fed in a guideway to the end cap applying station where they abut the end of the guideway and are aligned on at least one coincident longitudinal axis with the end wall of each end cap facing away from the conducting component body. A reciprocating member forces the end caps on each end of the body.

Preferably, however, the end caps, before they are placed on the component body ends, are moved to a solder application station wherein they are oriented generally vertically with the open portion of the end cap facing upwardly and below a wire solder feed station. A continuous wire of solder is fed from the feed station and small segments of the solder wire are chopped off by a severing mechanism at the feed station whereupon the chopped off sections of solder wire fall into the end caps.

A resistance element is brought into contact with the end caps to melt the chopped segment of solder lying in each end cap. After the solder melts and coats the inside of the end cap, the resistance heating of the end cap is terminated. At this point, the end caps are sent to the end cap applying station described above.

When pre-soldered end caps, such as those described above, have been applied to the body ends of the component, the end caps are preferably again heated by resistance heating to remelt the solder in the end caps so the solder flows throughout the cap to bond the conductor end portion to the end cap. Preferably, the resistance heating element is included with the above-described manner which pushes the end caps onto the body ends.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
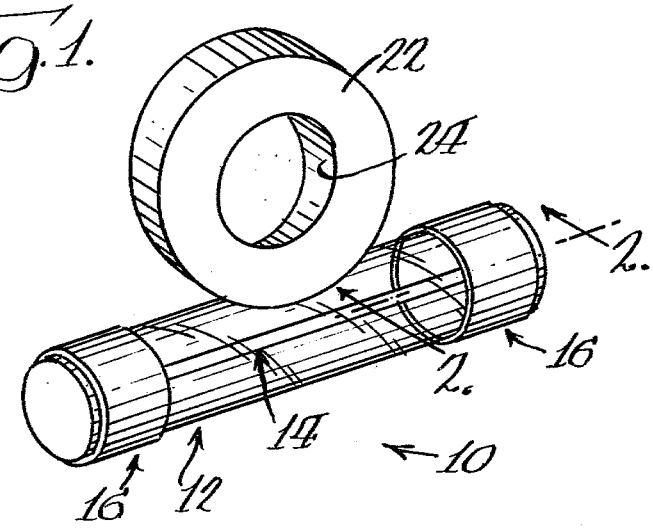
FIG. 1 is a perspective view of a fuse formed in accordance with the teachings of the present invention.

While the method and apparatus of this invention are susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to an embodiment which is simple and straightforward.

Referring now to the drawings, an electrically conducting component which can be made by the apparatus and method of the present invention is shown, in the form of a fuse, in its entirety at 10 in FIG. 1, and includes a body 12, a fusible link 14, and end caps 16. This fuse is fully described in the previously discussed patent application Ser. No. 820,724 and only a brief description will be given here.

Figure 2:
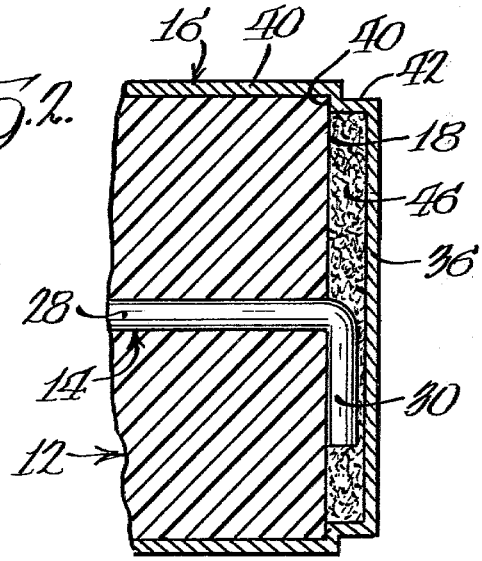
FIG. 2 is an enlarged, fragmentary, cross-sectional view of the right-hand end of the fuse shown in FIG. 1.

In the illustrated embodiment, body 2 is a solid, unitary, generally cylindrically-shaped member having flat, parallel, opposite end surfaces 18 (illustrated in FIG. 2). The body 12 is preferably formed by a molding process with the fusible link 14 having been previously placed in the cavity of the mold, so as to be positioned centrally within the body 12. The body 12 is preferably formed from nylon or a clear plastic material, such as the thermoplastic polycarbonate resin sold by General Electric Company under the trademark "LEXAN." Other clear, tough, heat-resistant, dimensionally stable, non-conductive plastic materials may also be used, such as high impact polystyrene, cellulose propionate, cellulose acetate-butyrate, etc. While thermoplastic materials are preferred, the present invention contemplates that certain thermosetting materials may be used. The particular plastic material that is utilized is selected so that its properties, in combination with the properties of the fusible link, give the resulting fuse the desired rating and performance characteristics.

While body 12 is generally cylindrically shaped, as previously described, a gripping handle 22 is preferably formed integrally with the body to facilitate insertion and removal of the fuse in a fuse holding clip structure, not shown. Handle 22 may be provided with an opening 24, so that the fuse may be readily carried (or displayed) on a key chain, or the like. The generally cylindrical configuration is preferred, although it is contemplated that the fuse body may be other than circular in cross section, e.g., oval, square, hexagonal, etc. In all fuse bodies, it is desired that at least the end portion thereof be circular in cross section, so as to readily accept conventional end caps, as will hereinafter appear. The fusible link 14 is in the form of an elongate wire, which in the illustrated embodiment is circular in cross section and centered relative to body 12, as previously mentioned. The external surface of the major portion 28 of the fusible link (FIG. 2), which is embedded in situ in body 12 by virtue of the molding operation, is in intimate surface-to-surface contact with the thermoplastic body 12.

The wire 14 is preferably, although not necessarily, a low-melting point alloy such as, for example, an alloy consisting essentially of from about 95 percent tin to about 5 percent lead. The present invention contemplates the use of fusible link wires 14 having diameters of between 0.010 and 0.050 inch, depending on the current rating of the fuse. While low-melting point alloys are preferred, the present invention also contemplates that the fusible link may be formed of copper, steel, or aluminum, although with such metals, a very fine filament must be used. While the wire 14 has been illustrated as being circular in cross section throughout its length, for certain applications it may be desirable to give the wire a different configuration, as by flattening the midportion thereof, as will be understood by those skilled in the art. In addition to flattening, the present invention contemplates that other operations, such as trimming, punching, stretching, etc., may be performed on the fusible link. Of course, if the wire is given a special configuration, this must be done prior to the molding operation.

Referring particularly to FIG. 2, it will be noted that the wire 14 has end portions 30 which are bent, angled, or otherwise shaped, to lie out of alignment with the major portion 28 of the fusible link 14. The end portions 30 are bent at a substantially right angle to the major portion 28 of the fusible link 14 so that they lie parallel and adjacent to the end surface 18 of the fuse body 12. However, it is to be realized that other end portion configurations are possible.

Although a detailed description of the method of making the fuse is given hereinafter, a brief description is given here to promote a better understanding of the detailed structure of the end cap. The fuse is preferably manufactured by extending a single elongate fuse wire 14 between a plurality of cavities of a multi-cavity mold. In a two-step molding process, a plastic material of the above-described type is then injected into each of the cavities while the wire is similtaneously retained in centered relationship with respect to the cavities, to first form one half of each fuse body 12 and second, the other half. Subsequent to the molding operations, the outwardly projecting end portions 30 of the wire 14 are severed to provide wire end portions 30. The end portions are then bent in the illustrated configuration to provide for improved electrical contact and thermal conduction between the fusible link 14 and the end caps 16 when the end caps 16 are subsequently placed on the fuse body ends.

Alternatively, the ends 30 of the fusible link 14 may be left extending generally outwardly from the fuse body 12 and substantially perpendicular to the fuse body end surface 18. Then the end caps 16 are assembled to the body 12 by axial relative movement therebetween. Each end cap 16 has an end wall 36 which, when an end cap 16 is moved onto the end of the fuse body 12, engages the end 30 of the fusible link 14 and causes it to bend over towards or against the fuse body end surface 18 in the orientation illustrated in FIG. 2. The end portion 30 need not lie directly flat against the end surface 18 but may be angled outwardly with respect thereto.

In order to accommodate high-speed manufacturing of the fuse with end cap applying apparatus of the present invention which may not always be properly adjusted, an end cap structure is provided to prevent severing of the end portion 30 of the fuse wire 14 and to provide a reservoir for an electrically conducting fluid material to improve electrical conductance between the end cap 16 and the element 14. Specifically, each end cap is a cup-shaped element that includes, in addition to the end wall 36, a sidewall comprising a first cylindrical portion 40 and a second cylindrical portion 42 having a diameter less than the first portion and joined to the first portion by an annular shoulder 44. The inside surface of the sidewall, and specifically the inside surface of the first cylindrical portion 40, is adapted to compressively engage or embrace the sidewall of the fuse body 12 adjacent the end to which the cap 16 is applied.

The cap 16 is inserted onto the end of the fuse body 12 until the annular shoulder 44 bears against the fuse body end surface 18 in direct contact therewith. In this manner, the annular shoulder 44 acts as an abutment means to prevent the end cap from being pushed onto the end of the fuse body 12 by more than a certain amount. This serves to maintain the end wall 36 at a predetermined distance from the fuse body end surface 18.

With certain types of small diameter fuse wires 14, and with certain types of end cap applying apparatus operated at high speeds, the tendency to push the end caps 16 against the end surface 18 of the fuse body 12 with sufficient force to sever the end portion 30 of the fuse wire 14 is thus accommodated. That is, if the length of the second cylindrical portion 42 is made equal to, or slightly greater than, the diameter of the end portion 30, the end portion 30 cannot be compressively engaged between the fuse body end surface 18 and the end cap end wall 36 with sufficient force to sever the end portion 30 from the major portion 28 of the fusible link wire 14. Thus, high speed end cap applying apparatus can be used even though they tend to force the end cap 16 onto the ends of the fuse body 12 with an undue amount of force. Thus, the need for maintaining such end cap applying apparatus in a carefully calibrated operating condition is substantially reduced or eliminated.

The second cylindrical portion 42 forms a reservoir or chamber for receiving an electrically conducting material such as an eutectic metal alloy 46 as illustrated in FIG. 2. The electrically conducting material 46 may be an electrically conducting solder or other suitable material, such as a solder paint or other conductive paint. Solder, comprising 66-⅔ parts by weight of tin and 33-⅓ parts by weight of lead is preferably used as the electrically conducting material 46. The electrically conducting material 46 is deposited as a solid, generally cylindrical charge of flux core solder (about 0.062 inch in diameter and 0.125 inch in length) or as a liquid drop into an end cap 16 when the end cap is in a vertical position with the end wall 36 at the bottom. When a solid charge of material 46 is used, the end cap 16 may be preheated or may be subsequently heated to cause the material to flow over the inner surfaces of the end cap. Preferably, a predetermined amount of solder 46 is deposited so that about 85 percent of the volume of the reservoir in the end cap 16 is filled. The solder 46 rapidly cools and solidifies as a coating on the inside of the end cap 16. The end cap 16 is subsequently placed on the fuse body and the end cap is heated to remelt the solder 46 around the wire-like fuse element end portions 30.

The electrically conducting material or solder 46 improves electrical conductance between the end caps 16 and the wire-like fuse element 14. Specifically, if the end wall 36 of the end cap is spaced outwardly of the bent over end portion 30 of the fusible link 14 so that it is not in contact therewith as illustrated in FIG. 2, the remelted electrically conducting material or remelted solder 46 serves to provide an electrically conducting path between the fuse link end portions 30 and the end cap 16. This is especially advantageous when using high speed end cap applying machines which may, owing to improper calibration or impact rebound, tend to pull the end cap 16 slightly away from the fuse body end 18 after initially placing the end cap 16 thereon.

Preferably, the solder is used with a flux in the form of a flux core solder. Typically, after the solder is deposited as a drop of liquid in the end cap 16 or as a solid charge of flux core solder in a pre-heated or subsequently heated end cap 16, much of the flux in the solder rises to the surface of the drop and forms a layer or coating of flux over the entire concave surface of the solder within the reservoir of the end cap 16. Both of the solder per se and the flux layer on top of the solder cool and solidify very rapidly and before any subsequent steps in the manufacturing process can be undertaken. After the end cap 16 has been properly placed upon the fuse body end, heat is applied to the end cap 16 to effect a remelting of the solder to cause the solder to flow between and around the end cap end wall 36, the fuse body end surface 18, and the fuse link end portion 30.

With some types of solder, a high temperature may be required to remelt the solder than was required to first melt the solder originally. This may be because of the creation of the flux coating on the surface of the solder deposit in the end cap or because of other changes within the solder brought about by the first application of heat. In any case, when the remelted solder 46 flows around the fusible link end portion 30, it is desirable that the temperature of the liquid solder be less than the temperature required to melt the fusible link end portion 30. Preferably, the remelting temperature of the solder should be between 80° and 100° F. less than the melting temperature of the fuse link end portion 30.

Owing to the fact that the end wall is displaced outwardly a predetermined distance from the fuse body end surface 18 by annular shoulder 44, heat that is applied to the end cap end wall 36 is conducted through the end wall and to the drop of solder with very little of the heat being conducted to the fuse body end surface 18 and fuse link end portion 30. Most of the heat is conducted through the end cap end wall 36 to the solder drop which acts as a heat sink. The temperature of the solder drop is then raised above its melting point so that it becomes liquid.

In practice, it has been found that with appropriate application of heat to the end caps for a very short period of time, as by resistance heating, the surface coating of the flux on the solder deposit within the end cap 16 becomes liquid slightly sooner than, or at least at the same time as, the solder beneath it. In any case, the flux coating on the surface on the solder deposit is so quickly and sufficiently heated that is is violently agitated against the fuse link end portion 30 so that it effectively cleans and coats the fuse link end portion 30. By the time the fuse link end portion 30 has been cleaned and coated with the flux, the solder deposit has remelted and has also been sufficiently heated to become violently agitated so that it flows throughout all portions of the chamber defined by the end cap 16 and the fuse body end surface 18. The liquid solder then wets, and bonds to, all the surfaces cleaned by the flux—especially the fuse link end portion 30. Thus, any time-consuming and expensive requirement for separately cleaning and fluxing the fuse link end portion 30 is eliminated. Since relatively little heat is transmitted directly to the fuse link end portion 30 and the fuse body end surface 18, the likelihood of the melting of the fuse link end portion 30 and the fuse body material is greatly reduced. After the solder has been melted and violently agitated to flow throughout the reservoir or chamber within the end cap 16, it cools and solidifies very quickly upon termination of the application of heat to the end cap 16. The result is that relatively little heat is transmitted to the fuse body during this process.

The wire-like fusible element 14 may be formed of material having a degree of inherent resiliency whereby the end portions 30, after being initially bent over, are urged outwardly against the end walls 36 of the caps 16. However, as previously stated, with the use of the electrically conducting material 46, this is not necessary because the fuse link end portions 30 need not be in direct contact with the end cap walls 36.

With reference to FIG. 2, it is to be observed that the reduced diameter of the cylindrical portion 42 relative to the cylindrical portion 40 provides a chamber which is defined, on one side, by the fuse body end surface 18 and that the remelted electrically conducting material 46 is thus substantially prevented by the end surface 18 from being forced out of the chamber and between the first cylindrical portion 40 and the fuse body 12. Thus, undesirable loss of the material 46 is substantially reduced.

The inner diameter of the sidewall or first cylindrical portion 40 of end cap 16 is preferably about the same size of the outer diameter of the end portion of the fuse body 12, so as to be positively retained thereon. To facilitate assembly, the end caps 16 may be heated prior to placement on the fuse body, with the subsequent shrinkage of the end caps 16 upon cooling causing them to strongly grip the fuse body. The hot end caps 16 also tend to melt the portions of the plastic body in contact therewith, so that the end caps adhere to the ends of the fuse body.

The first cylindrical portion 40 of the end cap 16 is sized so as to comply with previously existing standards, such as those established by the Society of Automotive Engineers. As is well known, the end caps 16 may be formed of brass, or a brass alloy and may be plated to prevent oxidation. End caps 16 are assembled to the outer end portion of the fuse body 12 by shifting the end caps axially of the fuse body, and the end caps 16 are preferably simultaneously placed on the fuse body 12.

Though a fuse is illustrated in FIGS. 1 and 2, it is contemplated that the method and apparatus of the present invention for making an encapsulated component and applying end caps thereto can be used with other suitable electrically conducting components which are encapsulated by a material, e.g., resistors, capacitors, transistors, and the like. Further, though the end caps are illustrated as having a cylindrical first portion and sidewall, other end cap shapes, as well as other component body shapes, may be used and the end cap sidewall may or may not compressively embrace the body.

Figure 3:
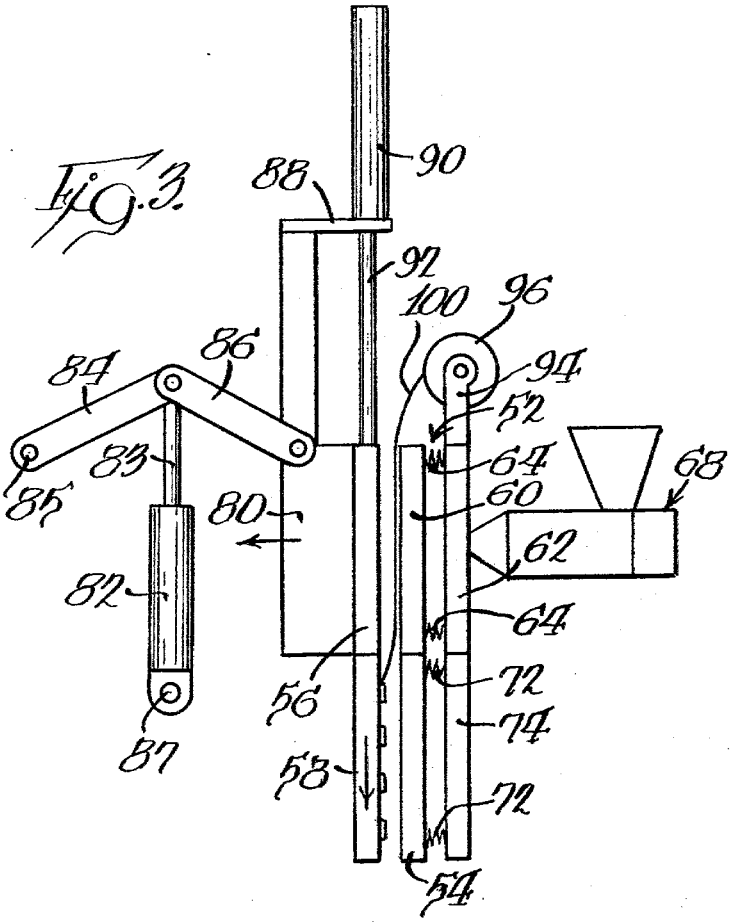
FIG. 3 is a schematic diagram of the molding apparatus of the present invention showing a continuous fuse wire located between spaced apart first and second molds.

FIGS. 3–7 schematically illustrate one form of the method of forming the encapsulating body around a fusible link or wire. FIG. 3 shows a vertically fixed assembly of a first mold 52 and a trim die 54 aligned in a generally vertical orientation parallel to and facing a vertically and horizontally reciprocable assembly of a second mold 56 and a third mold 58.

The first mold 52 includes a horizontally movable front cavity portion 60, a rear fluid plastic material distribution channel portion 62, and an assembly of springs 64 fixed between the front cavity portion 60 and the rear channel portion 62 to normally bias the front cavity portion 60 outwardly from the rear channel portion 62.

The front cavity portion 60 preferably has a plurality of cavities (not illustrated) arranged in a number of vertically aligned rows. Each cavity is defined by a concave surface within the mold which corresponds to the outer surface of about one-half of the thermoplastic fuse structure (taken along the plane of the fuse structure passing through the longitudinal axis of the cylindrical body portion 12 illustrated in FIG. 1).

The cavities are aligned in each vertical row in the first mold so that the longitudinal axis of each cavity defining the surface of the fuse body (body 12 in FIG. 1) is in a generally vertical orientation and hence, so that the cavity surface defining the body end for one cavity is adjacent the cavity surface defining the body end for the cavity immediately below or above it in the same row. The portion of the cavity defining the surface for forming the exterior surface of the gripping handle 22 (as illustrated in FIG. 1) lies to one side of the portion of the cavity for forming the fuse body 12.

An appropriate gate system (not illustrated) in the first mold provides communication between the interior of each cavity and the back surface of the front cavity portion 60. The gate system is adapted to communicate with corresponding plastic material distribution channels (not illustrated) in the rear portion 62 of the first mold 52 when the front cavity portion 60 is moved against the spring 64 and into contact with the rear channel portion 62. The rear channel portion 62 is adapted to be connected to a conventional injection molding machine 68. Such a molding machine 68 is well known to those skilled in the art and no further description will be given here.

When the front cavity portion 60 is pushed against the rear channel portion 62, fluid plastic material can be discharged from the plastic molding machine 68 and can pass into the channels of the rear channel portion 62 to the gates in the front cavity portion 60 from which the material flows into the cavities.

Vertically aligned below the front portion 60 of the first mold 52 is a trimming or trim die 54 which is adapted to sever fuse wires between the encapsulating bodies as will be explained in more detail hereinafter. The trim die 54 may be secured to the bottom of the front cavity portion 60 of the first mold 52 or to an overall frame (not shown), which frame may support both the front cavity portion 60 of the first mold 52 and the trim die 54. Preferably, a backing plate 74 is provided behind the trim die 54 and springs 72 are disposed between the trim die 54 and plate 74 having about the same overall spring constant as the springs 64 between the two portions of the first mold 52.

It is apparent from the above-described construction that both the front cavity portion 60 of the first mold 52 and the trim die 54 can reciprocate together in a horizontal direction while remaining in generally vertical alignment.

The second mold 56 preferably presents a substantially flat surface towards the front cavity portion 60 of the first mold 52. However, for guiding the fuse wires as will be explained in more detail hereinafter, the second mold 56 preferably has a plurality of grooves running in a generally vertical direction and aligned in registry with the center of the portion of the cavities defining the surface of the fuse body 12 in the front cavity portion 60 of the first mold 52.

The third mold 58 may be secured to the bottom of the second mold 56 or to a suitable frame (not illustrated), which frame may support both the second mold 56 and the third mold 58. The third mold 58 is aligned generally vertically below the second mold 56 and the parting planes of both molds are coplanar. The third mold 58 has a plurality of rows of cavities having substantially the same shape as, and arranged in a substantially mirror image of, the cavities in the front cavity portion 60 of the first mold 52. The shape of each cavity in the third mold 58 is such that, when the third mold 58 is aligned in registry with the first mold 52 and abutted thereagainst at the parting plane, a complete composite cavity is defined which has essentially the same shape as the thermoplastic material portions of the fuse 10 illustrated in FIG. 1.

The second mold 56 and third mold 58 are movable together in both the horizontal and vertical directions. To this end, the molds are supported from a suitable support member 80. The support member 80 is movable with the second mold 56 and third mold 58 in the horizontal direction by a suitable drive mechanism such as the hydraulic piston/cylinder actuator 82 operating through piston rod 83, links 84 and link 86. Link 84 and actuator 82 are pivotably supported by suitable frame (not illustrated), about pins 85 and 87, respectively.

A mounting bracket 88 is secured to the top of the member 80 for supporting another hydraulic piston/-cylinder actuator 90. The actuator 90 is connected through its piston rod 92 to the second mold 56 (or to a suitable frame (not illustrated) which in turn supports the mold 56 and/or 58). Operation of the actuator 90 raises and lowers the second mold 56 and third mold 58 together relative to the support member 80. In contrast, operation of the actuator 82 moves the second mold 56 and third mold 58, along with the support member 80 and actuator 90, against or away from the assembly of the first mold 52 and trim die 54.

Although hydraulic actuators 82 and 90 have been illustrated as effecting the vertical and horizontal reciprocating movement of the second mold 56 and third mold 58, it is to be understood that any suitable means for so moving the molds may be used.

A plurality of spools 96 are mounted above the first mold 52 and secured to the top of the rear channel portion 62 by bracket 94. On the spools 96 are wound continuous lengths of fuse wire 100. In the side view illustrated in the FIG. 3 schematic diagram, only one spool 96 and one wire 100 is shown. It is to be understood that a plurality of such spools 96 are preferably mounted above the molds in a direction perpendicular to the plane of FIG. 3. There is one spool of wire associated with each vertical row of cavities in the first mold 52 so that each wire 100 can ultimately be aligned substantially in the middle of the portion of each cavity defining the surface of the fuse body 12.

FIG. 3 illustrates how the molds would appear after one or more sequences of molding the thermoplastic bodies according to the method of the present invention had been executed. The second mold 56 and third mold 58 are shown spaced outwardly of the first mold 52 and trim die 54. Further, the third mold 58 is shown with a set of completely molded fuse bodies (without the end caps) projecting from the cavities in the third mold 58. The wire 100 hangs down between the second mold 56 and the front cavity portion 60 of the first mold 52 and then enters the molded fuse bodies contained in the third mold 58. If no previous molding sequences had occurred, then there would be no molded thermoplastic bodies projecting from the third mold 58 and the fuse wire 100 would hang generally vertically downwardly between the third mold 58 and the trim die 54 in the same manner that the wire 100 is illustrated as hanging between the second mold 56 and the first mold 52 above.

The various steps of the method of molding a thermoplastic fuse body in accordance with the present invention will next be described in detail with seriatim reference to FIGS. 3–8.

The molding sequence will be described with respect to just one spool 96 of wire 100 and with a corresponding single row of cavities in both the first mold 52 and third mold 58 and with a corresponding single row of wire-receiving grooves in the second mold 56. It is to be understood that the same sequence is simultaneously occurring with respect to the remaining plurality of rows of cavities and grooves in the molds corresponding with the other spools 96 of wire 100.

To begin the molding sequence, it is assumed that (1) the third mold 58 already contains a plurality of thermoplastic fuse bodies as illustrated in FIG. 3 and as described above, and (2) the second and third molds 56 and 58, respectively, are spaced outwardly away from the first mold 52 as illustrated in FIG. 3.

Figure 4:
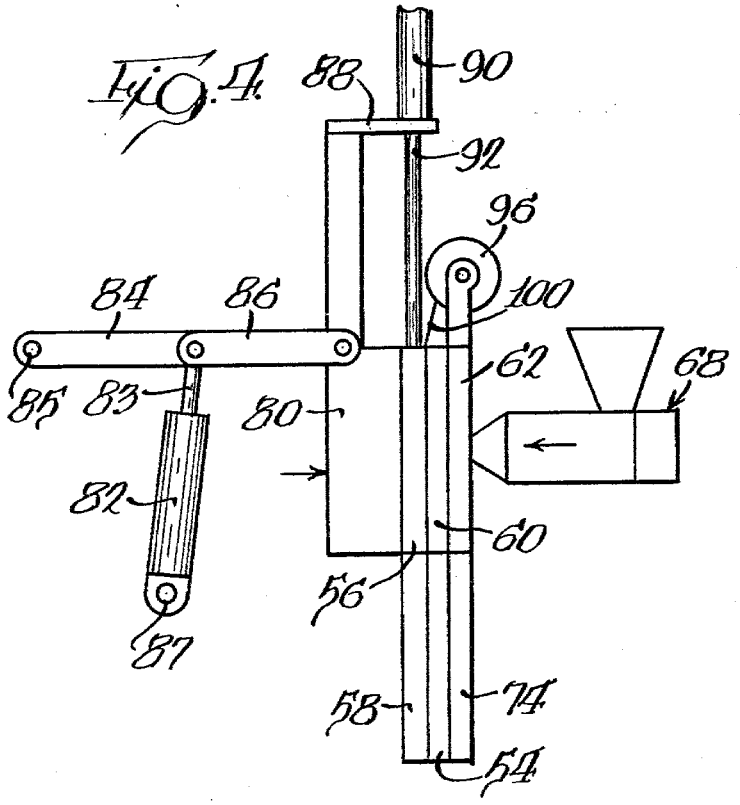
FIG. 4 is a schematic diagram of the mold apparatus of FIG. 3 showing the second mold forced against the first mold during the injection of thermoplastic material into the cavities of the first mold.

FIG. 4 illustrates the next step in which the second mold 56 is moved horizontally against, and in registry with, the front cavity portion 60 of the first mold 52. As this happens, the wire 100 is received in the vertical groove in the second mold 56 and is forced across the vertically aligned cavities in one vertical row of the front portion 60 of the first mold 52.

It is to be noted that when the second mold 56 and third mold 58 are moved vertically downwardly as illustrated in FIG. 3, the fuse wire 100 is pulled downwardly with the fuse bodies in the third mold 58 and unreels from spool 96. The wire 100 is thus positively fed by this method and becomes oriented across the front of the first mold between the second and first mold. If necessary, additional guides (not illustrated) can be provided on the top and/or the bottom of the front cavity portion 60 of the first mold to insure proper alignment of the wire 100 across the cavities in the front cavity portion 60. Proper alignment is necessary to insure that the wire 100 will be received in the wire receiving grooves of the second mold 56 when the second mold 56 is moved against the first mold as illustrated in FIG. 4.

After the second mold 56 has been forced tight against the cavity portion 60 of the first mold, fluid plastic material is injected from the injection mold machine 68, through the channel distribution system of the rear portion 62 of the first mold, through the gating system in the front cavity portion 60 of the first mold and finally into the cavities in the front portion 60 of the first mold. The fluid plastic material is retained by the substantially flat wall of the second mold 56 and encapsulates a portion of the wire 100 projecting into each cavity from the groove of the second mold 56—preferably between 180° and 270° of the circumference of the cylindrical surface of the fuse wire 100.

Figure 5:
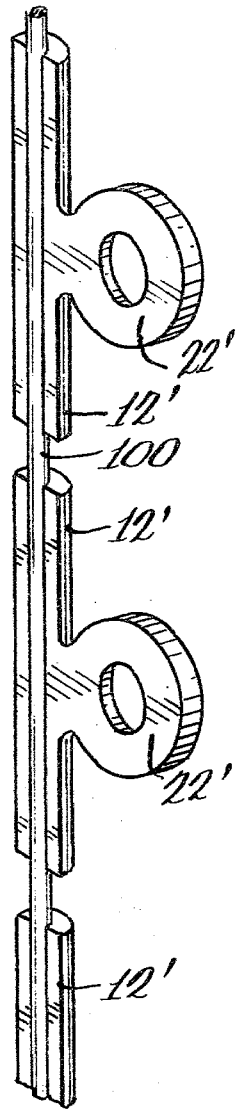
FIG. 5 is an illustration of a string of composite structures molded from a first injection of the thermoplastic material into the confronting first and second molds.

The thermoplastic material solidifies to form substantially one-half of the thermoplastic fuse body containing the fuse wire as illustrated in FIG. 5. That is, one-half of the gripping handle 22' is formed (which corresponds to the gripping handle 22 in FIG. 1) and one-half of the fuse body 12' is formed (which corresponds to the fuse body 12 in FIG. 1). To insure that the wire 100 is securely partially encapsulated by the plastic, it may be desirable to design the groove in the second mold 56 to accommodate an additional amount of plastic adjacent the wire so as to encapsulate more than one-half of the circumferential surface of the fuse wire as discussed above. In any case, the fuse wire 100 runs continuously through the vertically aligned plastic structures thus formed.

As can be seen with reference to FIG. 4, when the second mold 56 is moved against the front cavity portion 60 of the first mold, the third mold 58 is necessarily moved against the trim die 54. The trim die has appropriate cutting surfaces which sever the wire 100 between the previously completed molded fuse bodies (which are shown projecting from the third mold 58 in the previous step illustrated in FIG. 3).

Figure 6:
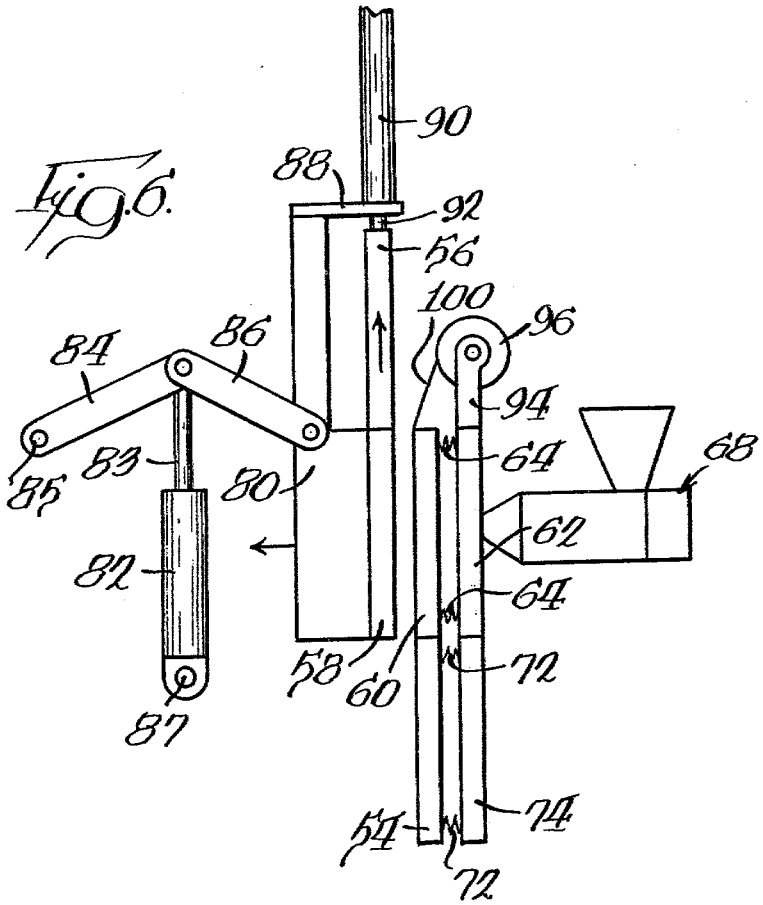
FIG. 6 is a schematic diagram of the apparatus illustrated in FIG. 3 illustrating the third mold moved upwardly and in alignment with the first mold but spaced therefrom.

The next step in the sequence of molding the thermoplastic body is illustrated in FIG. 6 wherein the second mold 56 has been moved outwardly away from the front cavity portion 60 of the first mold and then moved upwardly along with the third mold 58 so that the third mold 58 is spaced from, but aligned in registry with, the front cavity portion 60 of the first mold 54. It is to be noted that the composite of the fuse wire 100 and the "one-half" molded fuse bodies still remain in the front cavity portion 60 of the first mold.

Before or during the raising of the third mold 58 along with the second mold 56 as illustrated in FIG. 5, the completely molded thermoplastic bodies originally in the third mold 58, if any, may be removed by suitable stripping means well known to those skilled in the art. Consequently, when the third mold 58 is raised in registry with the front cavity portion 60 of the first mold as illustrated in FIG. 6, the third mold cavities are empty.

Figure 7:
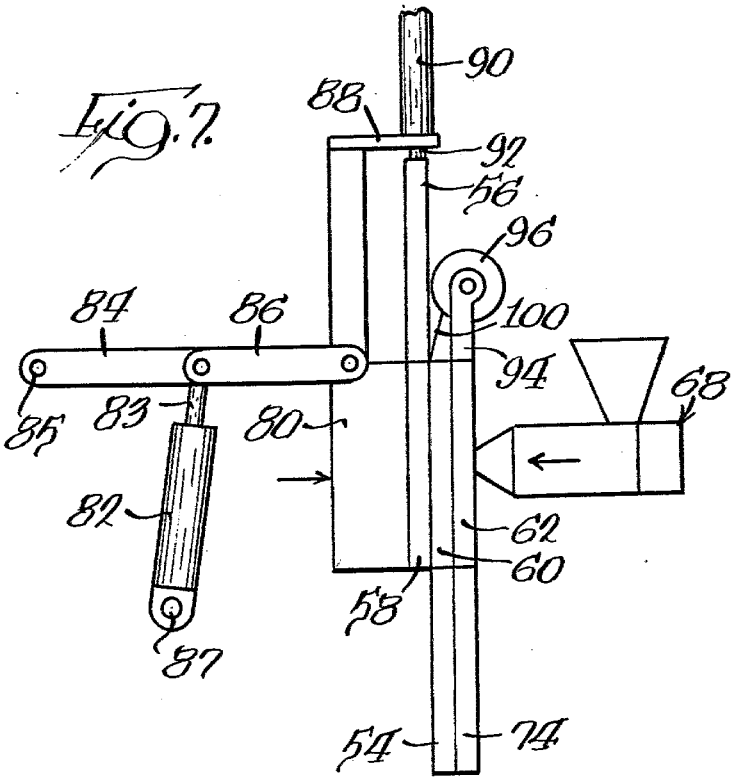
FIG. 7 is a schematic diagram of the apparatus of FIG. 3 showing the third mold forced against the first mold during injection of thermoplastic material into the mold cavities of the third mold.

As illustrated in FIG. 7, the third mold 58 is next forced against the front cavity portion 60 of the first mold. It is to be recalled that the fuse wire 100 has been molded, at least for about 180 degrees of its surface, by the solidified plastic material in each cavity of the first mold. The third mold 58 thus merely provides the "other halves" of the composite cavities necessary for forming the complete thermoplastic fuse bodies.

With the molds arranged as shown in FIG. 7, fluid plastic material is again injected from the injection molding machine 68 in the same manner as was previously described with reference to the step illustrated in FIG. 4. Since the cavities in the front cavity portions 60 of the first mold are filled with solidified thermoplastic material, the new, incoming fluid plastic material must either pass through or around the solidified material on its way to the empty cavity in the third mold 58. To this end, a variety of gating systems may be employed to reduce the amount of solidified material that the incoming plastic must pass through, typical systems being described herebelow.

For example, the second mold 56 may have a plurality of small prongs (about 0.05 inch in diameter), each projecting into a region of the cavity defining the annular gripping tab (22' in FIG. 5) to within about 0.01 inch of the surface of a cavity in the first mold. Thus, when the first injection of fluid plastic material is completed (as illustrated in FIG. 4) there will be a recess with only a 0.01 inch thick portion of plastic adjacent the opening of the gate into the cavity in the first mold. This 0.01 inch thickness of plastic will be ruptured during the second injection of fluid plastic material illustrated in FIG. 7. The new fluid plastic will flow through the recess that was defined by the prong and enter the cavity of the third mold.

Alternatively, other gating systems, may be used, for example, where a gate is provided in the first mold wall in the circular mold region inside of the annular gripping tab (22' in FIG. 5). If a gate is provided in the first mold cavity wall in the circular mold region inside of the gripping tab, a similar gate would have to be provided in the mirror image region in the third mold 58. The gate in the third mold 58 would continue into the mold cavity therein to allow the admission of the new thermoplastic material. With such a gate, a prong in the second mold 56 is not required since, when the second mold 56 is adjacent the first mold, the substantially flat wall of the second mold 56 would prevent any fluid plastic material from being injected from the gate. Obviously, one or more additional gates would have to be provided in other parts of the cavity in the first mold to allow the filling of the first mold cavity during the first injection.

Figure 8:
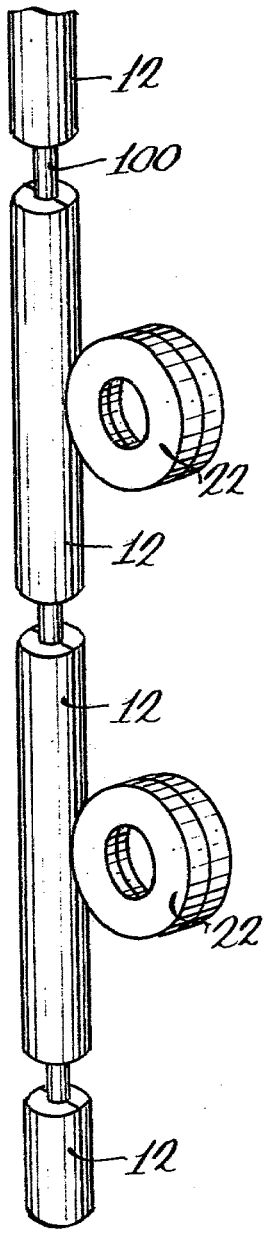
FIG. 8 is a prospective view of the completed, encapsulated, electrically conducting components formed when the molding illustrated in FIG. 7 has been completed.

In any case, after the second injection of fluid plastic material, a completed, encapsulated, electrically conducting component or fuse body (without the end caps, of course) is formed with a body 12 and tab 22 as illustrated in FIG. 8. As can be seen from FIG. 8, the molded fuse bodies are still connected in end-to-end fashion by the fuse wire 100. Although the body halves are molded separately, they unite and become unitary during the second injection of fluid plastic material and the resulting product is integral as though it had been molded in a single step.

In the next step (not illustrated), the third mold 58 is moved horizontally outwardly away from the front cavity portion 60 of the first mold. By appropriate design of the cavities in the first mold 52 and in the third mold 58, the completed thermoplastic fuse bodies are retained in the third mold 58 as it is pulled outwardly away from the first mold 52. When this happens, the cavities in the first mold will obviously be empty and ready to receive a new injection of thermoplastic material in the subject steps.

After the third mold 58 has been moved outwardly with the completed thermoplastic fuse bodies held therein and partially projecting therefrom, the third mold 58 and second mold 56 are moved vertically downwardly to align the second mold 56 in front of the first mold 52 and to align the third mold 58 with the trim die 54. This orientation is shown in FIG. 3 and is the "starting point" from which the entire molding sequence is repeated. Subsequent movement of the second and third molds against the first mold and trim die begins a new molding process and will cause the fuse wire 100 to be severed between the ends of the previously completed thermoplastic fuse bodies in the third mold 58.

It is to be noted that the novel method of injecting fluid plastic material from behind a first mold and through the first mold to form a fuse body defined between cavities of two confronting molds has the advantage of eliminating the necessity of injecting thermoplastic material along the parting line of the two confronting molds as is typically done in the prior art. The method of the present invention prevents displacement of the fuse link wire from its proper position in the cavity by inrushing plastic. This is because the fuse wire is held across the cavities in the first mold by the wire retaining grooves in the second mold during the first plastic injection step.

The novel method described above also has another advantage over the prior art technique of injection fluid plastic material at the parting line of two confronting molds. Specifically, with the method of the present invention described above, little or no runner is formed between the two molds.

Also, with the method of the present invention, the front cavity portion 60 of the first mold 52 is spring-biased outwardly away from the rear channel portion of the mold after the injection of the plastic material. Thus, the runner formed between the two portions of the first mold drops off and can be collected for reuse.

Figure 9A:
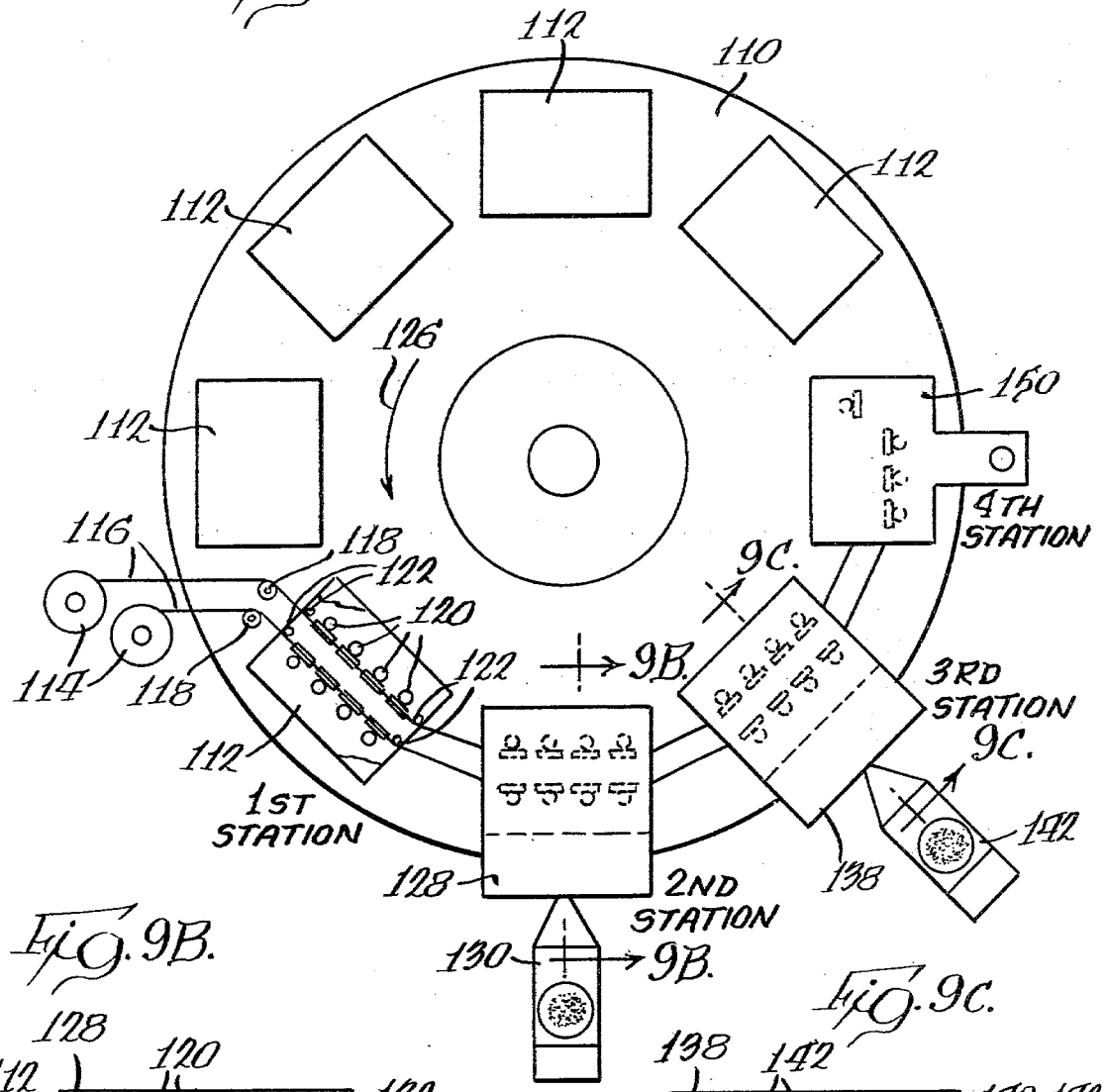
FIG. 9A is a second embodiment of the apparatus of the present invention for effecting the method of the present invention with respect to molding the component illustrated in FIGS. 1 and 2.
Figure 9B:
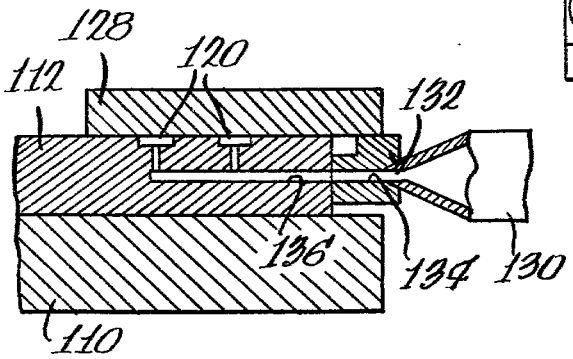
FIG. 9B is a fragmentary, cross-sectional view taken generally along the plane 9B—9B in FIG. 9A.
Figure 9C:
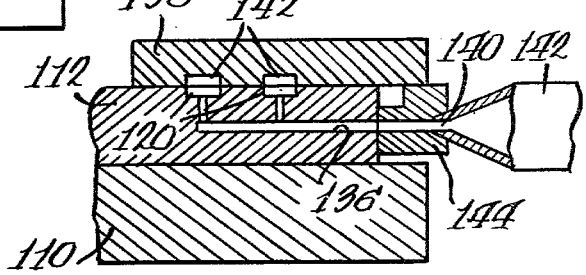
FIG. 9C is a fragmentary, cross-sectional view taken along a plane 9C—9C in FIG. 9A.

A second embodiment for executing the method of the present invention for molding a thermoplastic body around a fuse wire is illustrated in FIGS. 9A–9C. Instead of a reciprocating set of molds, a rotatable turntable 110 is provided for carrying a first mold 112 (analogous to the front cavity portion 60 of the first mold illustrated in FIGS. 3, 4, 6 and 7). Two spools or reels 114 of fuse wire 116 are provided off to one side of the turntable 110 and are mounted in fixed relation to the turntable 110. The fuse wires 116 are trained across a portion of the turntable 110 and are preferably guided at one point by rollers 118. The rollers 118 are not mounted to the turntable 110, but rather are mounted above the turntable by some suitable framework (not illustrated). Thus, as the turntable 110 rotates, the wires 116 maintain the same orientation above the turntable 110 in the region of the rollers 118.

The first mold 112 is illustrated as having two rows of fuse body cavities 20. These cavities 120 have a structure analogous to that described for the cavities in the front cavity portion 60 of the first mold which was described in detail above with reference to the first embodiment of the method illustrated in FIGS. 3–8.

Upwardly projecting guide pins 122 are provided on each end of the mold 112 for additionally guiding the fuse wires 116 in proper alignment across the center of the fuse body portions of the cavities 120.

According to this form of the method of the present invention, the turntable 110 has a plurality of first molds 112. Eight such molds 112 are illustrated in FIG. 9A as being equally, circumferentially spaced on the turntable 110. The turntable 110 rotates in the direction of the arrow 126 (counterclockwise as viewed in FIG. 9) and sequentially moves each mold 112 to a number of different stopped positions or stations about the circumference of the turntable. The number of stopped positions may correspond to the number of first molds 112 located on the turntable 110. However, this is not a necessary condition for executing the method of the present invention.

The minimum number of stopped positions that are required depends on the number of separate operations which must be performed on each first mold 112 at separate stations. If only four operations are required, and if eight molds 112 are included on a turntable 110 illustrated in FIG. 9, then two sequences of molding could be performed on one turntable. In such a case, another set of spools of wire could be provided on the other side of the turntable, in reverse symmetry, from the spools 114 and wire 116 illustrated in FIG. 9A.

According to this form of the method of the present invention, the first mold 112 is rotated from the First Station, where the fuse wires 116 are stretched across the mold, to a Second Station, where a second mold 128 overlies the turntable 110 and is adapted to move against each first mold 112. The second mold 128 is analogous to the second mold 56 described above for the first embodiment of the method and illustrated in FIGS. 3, 4, 6, and 7. The second mold 128 has two rows of grooves (not illustrated) for receiving the fuse wires 116 therein and for maintaining the fuse wires in proper alignment over the cavities 120 in each first mold 112. Except for the grooves, the second mold 128 presents a substantially flat surface towards the surface of the first mold 112 at the parting plane between the two molds.

An injection molding machine 130, analogous to the injection molding machine 68 described above for the first embodiment of the method and illustrated in FIGS. 3, 4, 6, and 7, is provided at the Second Station to inject fluid plastic material into the first mold 112.

As best seen in FIG. 9B, a fluid plastic material distribution channel block 132 may be provided between the injection molding machine 130 and the first mold 112 to provide flow channels 134 to carry the fluid plastic from the injection machine 130 to the mold 112. The mold 112 has a suitable array of channels or gates 136 for guiding the fluid plastic material into the cavities 120.

At the Second Station, the fluid plastic material is injected into the first mold 112 to form the "first half" of each thermoplastic fuse body. As described above with respect to the first embodiment of the method of the present invention, the semi-cylindrical surface of the fuse wire 116 which projects into each cavity 120 is encapsulated with the plastic material.

After the plastic material has cooled a predetermined amount, the second mold 128 is raised away from the first mold 112 (by means not illustrated) and the turntable 110 is rotated to bring the mold 112 to the Third Station. During this rotation from the Second Station to the Third Station, the fuse wire 116, being partially encapsulated in the first mold 112, travels with the mold 112 from the Second Station to the Third Station as an integral unit. This causes the fuse wire 116 to unreel from the spools 114. Thus, the fuse wire 116 is at all times properly drawn over the other two first molds 112 located in the First and Second Stations.

At the Third Station, a third mold 38 is provided over the turntable 110. The third mold 138 is adapted to move downwardly against the first mold 112 by means not illustrated. The third mold 138 is analogous to the third mold 58 previously described in detail with respect to the first embodiment of the method of the present invention and illustrated in FIGS. 3, 4, 6, and 7.

With reference to FIG. 9C, it is seen that the third mold 138 contains cavities 142 substantially identical and oppositely facing from the cavities 120 in the first mold 112. The cavities in the third and first molds form a composite cavity for defining the exterior surfaces of a completed, thermoplastic fuse body.

At the Third Station a second injection molding machine 142 is provided at the periphery of the turntable 110. As in the case for the Second Station, a distribution block 144 may be provided between the injection molding machine 142 and the first mold 112. The block 144 has a suitable array of channels 140 for guiding the fluid plastic material into the channels 136 in the first mold 112. By appropriate gating and other molding techniques (such as those explained more fully with reference to the first embodiment of the method of the present invention described above with respect to FIGS. 3–8) the injection molding machine 142 injects a second batch of fluid plastic material which passes either through or around the cavities in the first mold 112 and into the cavities 132 in the third mold 138 to form completed thermoplastic fuse bodies (similar to those bodies illustrated in FIG. 8 in the first embodiment of the method of the present invention).

After a predetermined cooling period, the third mold 138 is raised away from the first mold 112 (by means not illustrated). In this embodiment of the method of the present invention it may be desirable to allow the completed thermoplastic fuse bodies to remain in the first mold 112 rather than be carried away in the third mold 138 as was the case in the first embodiment of the method of the present invention described above.

With the completed thermoplastic fuse bodies remaining the first mold 112, the turntable 110 is then rotated to bring the mold 112 to the Fourth Station wherein a trim die 150 may be lowered against the mold 112 (by suitable means not illustrated) to sever the fuse wire 116 between the thermoplastic fuse bodies. The completed fuse bodies may be removed at the Fourth Station by suitable means or the turntable 110 may rotate to a subsequent station where the fuse bodies may be removed or where other operations may be performed on the fuse bodies.

With the method illustrated in FIGS. 9A–9C, fuse bodies can be molded very rapidly. As previously mentioned, a number of sets of stations (each set including spools, wires, a second mold, a third mold, and two injection molding machines) may be provided around a large turntable. The number of sets of such stations that may be so provided around a turntable is limited only by the size of the turntable and the size of the molds.

Although the mold 112 illustrated in FIG. 9 is shown as having only two rows of mold cavities 120, it is to be realized that more than two rows of cavities could be provided. Of course, additional spools of fuse wire equal to the number of additional rows of cavities would also have to be provided. Also, a number of rows of cavities in the second and third molds 128 and 138, respectively, would have to be concomitantly increased.

In FIGS. 9A–9C, the fluid plastic material is illustrated as being injected into the first mold 112 from the end of the mold 112. It is to be realized that the material could be injected from the back or bottom of the mold 112 by providing suitable gate and channel systems communicating with the back or bottom of the mold 112 and by relocating the injection molding machines 130 and 142, if necessary.

Although the first and second forms of the method of the present invention have been described above with respect to certain orientations and references to "up", "down", etc., it is to be understood that the various steps may be performed in any orientation.

After the thermoplastic component bodies have been molded by the method described above, the end caps (caps 16 illustrated in FIG. 1) must be applied to the ends of each body. A novel apparatus and method for applying the end caps is illustrated in FIGS. 10–17. A brief description of the major parts of the apparatus for applying the end caps will first be set forth with reference to FIG.10. The end caps 16 are fed from both of two feeders 200 along tracks 210 to solder application stations 214. At each station 214 a piece of solder wire is severed from a continuous solder wire 230 and dropped into an end cap. The end cap is heated to melt the solder so that a portion of the inside of the end cap is coated with the solder. The end caps continue along tracks 250 to end cap applying stations 260.

The thermoplastic fuse bodies 10' are also moved into the end cap applying stations 260. The fuse bodies 10' are initially moved from a feeder 300 along a track 320 to a rotting holder 350 which (1) receives the fuse bodies at spaced locations about its circumference, (2) moves the fuse bodies past a pair of spaced apart anvils 370 to bend the projecting end portions of the conductor fuse wires inwardly towards the respective body ends of each fuse body, and (3) moves the fuse bodies into the end cap applying stations 260 where two end caps are substantially simultaneously applied, one cap to each end of a fuse body. The end caps are then heated, in place on the fuse body, to remelt the solder and/or soften the end portions of the fuse body. The reheating of the solder causes the solder to flow within each end cap around the bent end portion of the fuse wire so that intimate contact between the fuse wire and end cap is achieved. The rotating holder 350 subsequently moves each end-capped fuse out of the end cap applying stations 260 to a discharge region and releases each fuse into an appropriate collecting device.

A more detailed description of the individual components of the apparatus for applying end caps will now be given, beginning with the specific components provided for handling the molded fuse bodies according to the method of the present invention.

Figure 10:
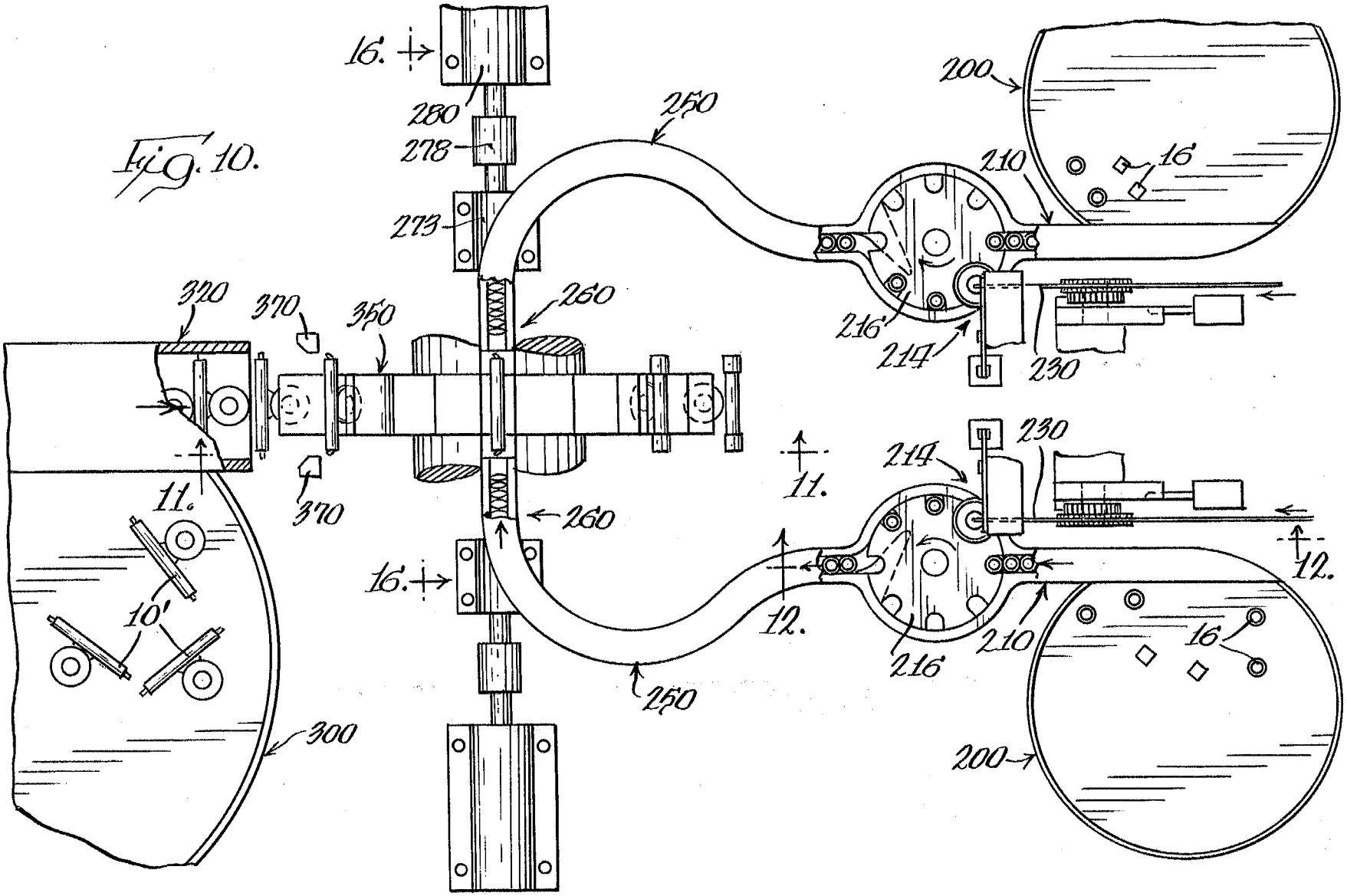
FIG. 10 is a fragmentary, plan view of the end capping apparatus used for effecting the method of the present invention.

With reference to the left-hand side of FIG. 10, it can be seen that a plurality of fuse bodies 10', without the end caps, are dumped or placed in a combination receiving and feeder means 300. The feeder 300 may be of any suitable type, such as the conventional cylindrical device having a threaded wall and a flat circular bottom which rotates relative to the threaded wall. Rotation of the bottom causes the fuse bodies 10' to travel up the threads of the wall and out of the feeder 300 into the track 320. By providing guide systems well known to those skilled in the art, the fuse bodies 10' are positioned in the feeder 300, or as they enter the track 320, so that they all have the same orientation as they are forced into the track 320.

The fuse bodies 10' which are placed in the feeder 300 have preferably been fabricated in accordance with the molding metnod described above. Thus, each has a body sidewall and oppositely facing body ends with a conductor element or fuse wire having opposite end portions, each end portion extending outwardly beyond one end of said body. In some cases, it is desirable to "pre-bend" the fuse wire end portions inwardly towards the fuse body ends. This is accomplished by bending the wire end portions after the fuse bodies have been picked up by the rotary holder 350 as will next be explained.

Figure 11:
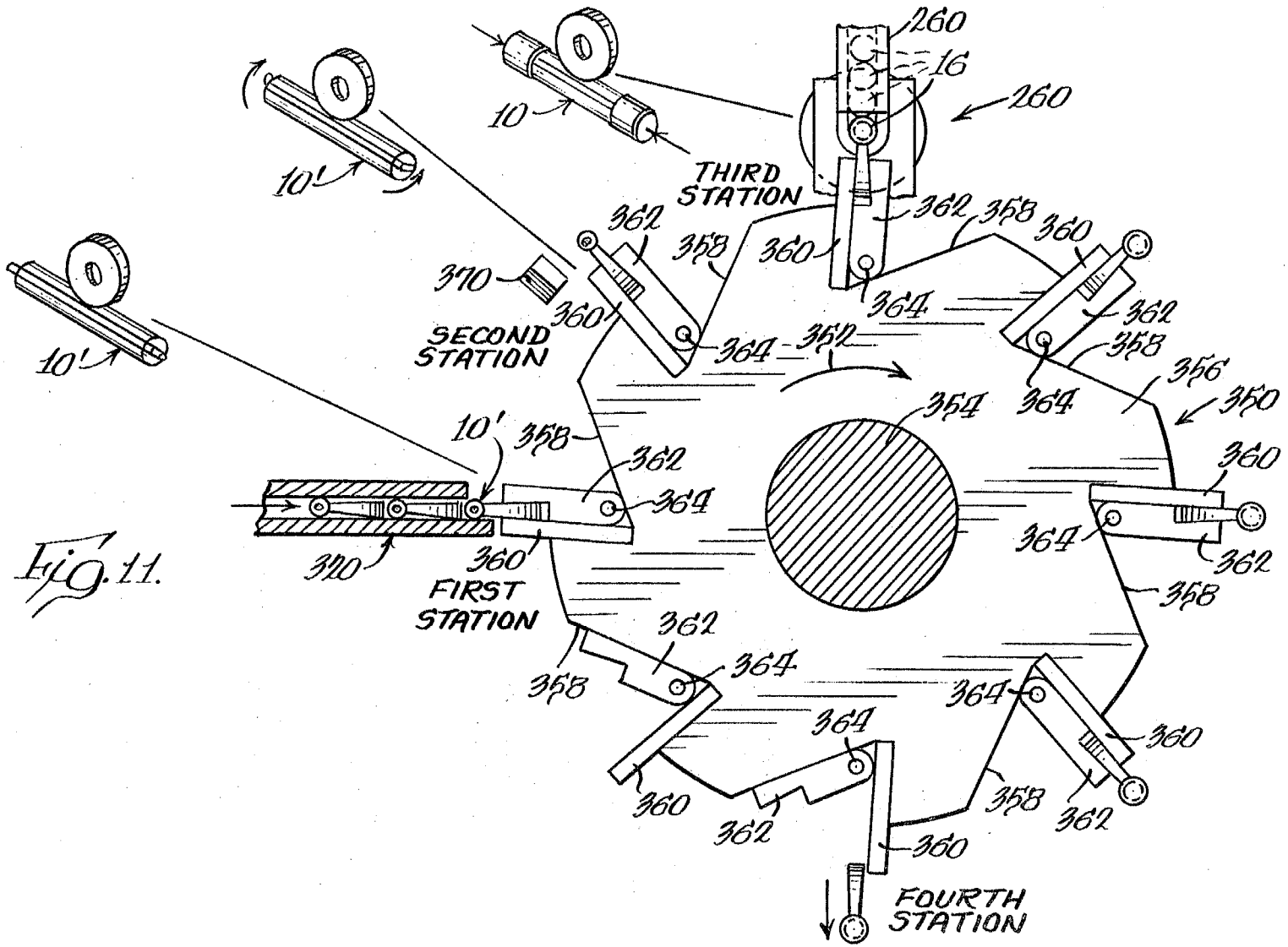
FIG. 11 is an enlarged, fragmentary, cross-sectional view taken generally along the plane 11—11 in FIG. 10.

FIG. 11 illustrates the relationship between the rotary holder 350 and the fuse body infeed track 320. The fuse bodies 10' are forced along the track 320 by the feeder 300 acting on the line of fuse bodies in the track 320 which extends between the rotating holder 350 and the feeder 300. The feeder 300 may be rotated intermittently, and if desired, may be rotated from a common drive system for the whole end capping apparatus through suitable transmission means (not illustrated).

The rotary holder 350 is driven in a clockwise direction indicated by the arrow 352 in FIG. 11 by shaft 354 which is connected to the drive mechanism (not illustrated). The rotary holder 350 includes a notched disc member 356 with a plurality of circumferential, generally V-shaped notches 358 therein. One side of each notch 358 has a bearing platform 360 for receiving the fuse bodies thereon.

A fuse body clamping member 362 is pivotably mounted in each notch 358 about a shaft 364 carried by wheel 356 or by suitable side frame members (not illustrated) secured to the sides of the wheel 356. Each clamping member 362 is preferably spring-biased outwardly away from the bearing member 360 (by a spring not illustrated). Each clamping member 362 is adapted to be moved towards and against the bearing plate 360 when the rotary holder 350 carries the bearing plate 360 into alignment with the fuse body track 320. Each clamping member 362 is forced downwardly against the gripping tab portion of the fuse body projecting from the track 320 to retain the fuse on the holder 350. The clamping member 362 may be rotated about the pivot shaft 364 against the bearing plate 360 by any suitable means (not illustrated) incorporated in the holder 350. Alternatively, the clamping member 362 may be spring biased in the closed position against the bearing plate 360 and may be opened by other suitable means to later discharge the fuse bodies.

The rotary holder 350 rotates intermittently through a predetermined angle of rotation to bring each fuse holding notch 358 into proper alignment with various stations that are spaced about the circumference of the holder 350. After clamping onto a fuse body in the track 320 at a stopped position at the First Station, the holder 350 is rotated through its predetermined angle of rotation. This carries the fuse body 10' a little ways past the spaced-apart anvils 370 (as best illustrated in FIG. 10). The spacing between the pair of anvils 370 is a little less than the distance between the outwardly extending fuse wire ends so that each fuse wire end is bent inwardly towards the respective fuse body end as the fuse body is carried past the anvils 370. This "prebending" assures that the end caps will not buckle the fuse wire in an irregular manner when the end caps are later applied to the fuse body ends.

If desired, the distance between the anvils 370 could be reduced to an amount that would cause the fuse wire ends to be bent substantially parallel to the adjacent fuse body end. This would eliminate the need for using the end caps to bend the fuse wire end portions inwardly. In fact, if the anvils 370 were arranged to bend the fuse wire ends to a position substantially similar to that illustrated in FIG. 2 for the wire end 30, and end cap having the shape of the end cap 16 in FIG. 2 could be applied to the fuse body without contacting the fuse wire end 30 during (and after) the application of the cap.

Nevertheless, in the preferred embodiment of the method illustrated in FIGS. 10 and 11, the fuse wire end portions are left angled outwardly from the fuse body so that the end caps, when they are applied, must necessarily force the end portions further inwardly towards the fuse body end. The completed structure would be similar to that illustrated in FIG. 2 except that the end portion 30 of the fuse wire would be angled outwardly at a very small angle and the distal end of the wire portion 30 would be in contact with the end wall of the cap.

Following the bending of the fuse wire end portions, the rotary holder 350 is rotated through the predetermined angle of rotation to bring the fuse body to the Third Station of the holder (FIG. 11)–the end cap applying stations 260. The orientation of the fuse body at the end cap applying stations 260 is more clearly illustrated in FIGS. 16 and 17.

The fuse body 10' is lying between, and equidistant from, the two end cap tracks 250. The end caps, preferably containing a solidified coating of solder which has been applied at the solder application station 214 (as will be explained in more detail hereinafter), are to be applied substantially simultaneously to each end of the fuse body.

Figure 16:
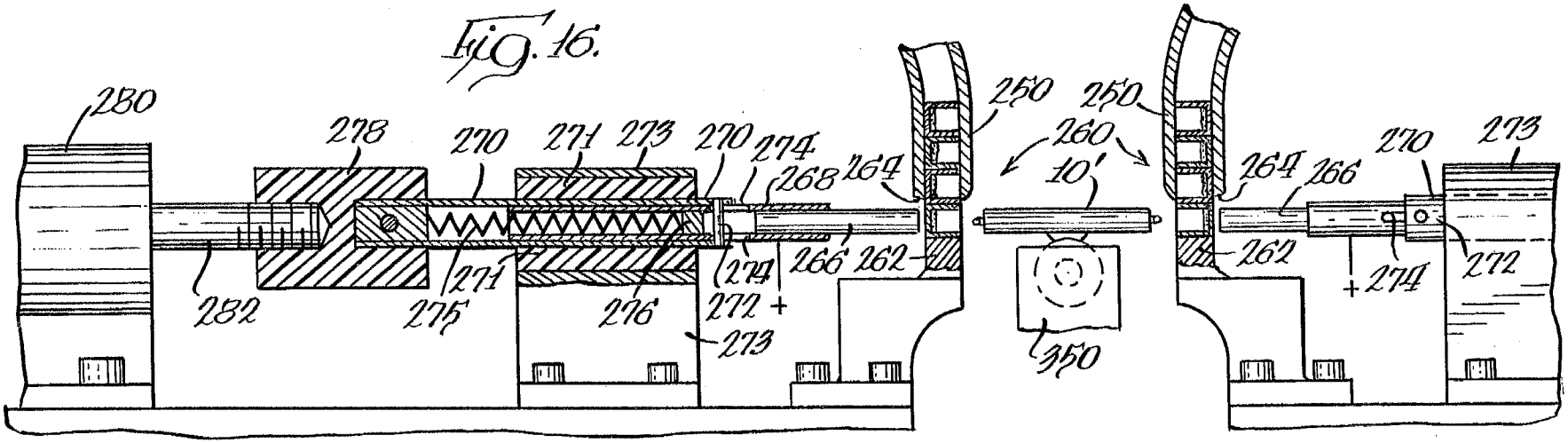
FIG. 16 is an enlarged, fragmentary, side view taken generally along the plane 16—16 in FIG. 10.

At the end cap applying stations 260 the tracks 250 are oriented generally vertically as illustrated in FIG. 16 so that the opening of each end cap faces an end of the fuse body 10' held in the rotary fuse body holder 350. An end wall 262 on each track 250 aligns the last end cap in each track along the longitudinal axis of the fuse body 10'.

Figure 17:
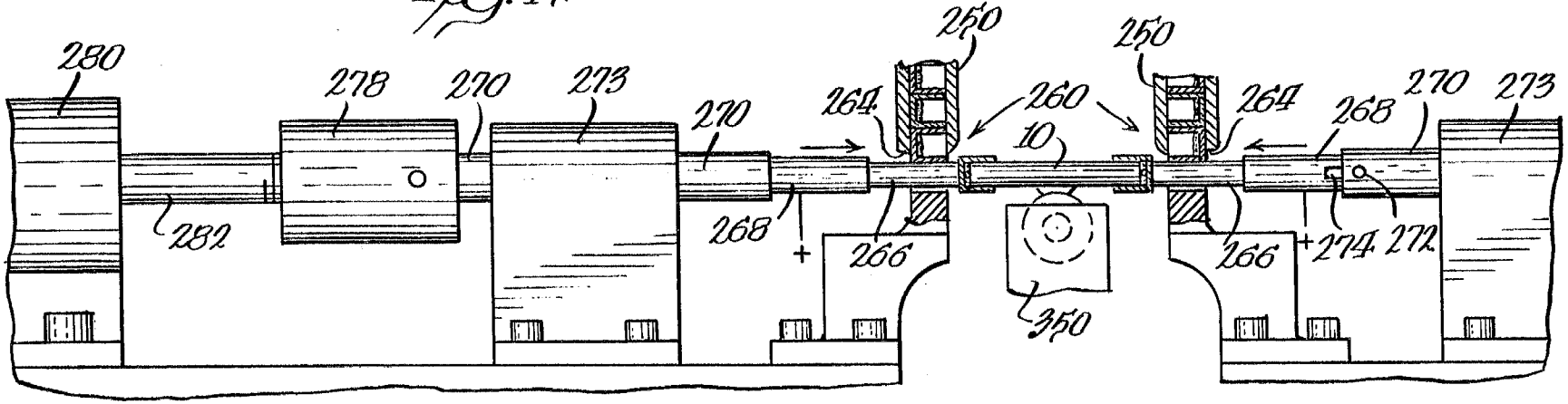
FIG. 17 is a view similar to FIG. 16 but showing the placement of the end caps on the ends of the conducting component.

An aperture 264 is provided in each track 250 for receiving a carbon push rod 266 which is reciprocable horizontally between a fully retracted position illustrated in FIG. 16 and a fully extended position illustrated in FIG. 17 wherein the end cap is forced onto the fuse body end fo form a completed, end-capped fuse 10.

With reference to the left-hand side of FIG. 16, it can be seen that the push rod 266 is secured to, and carried within, an inner sleeve 268. The inner sleeve 268 is slidably received in an outer sleeve 270. The outer sleeve 270 is supported for reciprocable movement within a bearing 271 mounted in a bearing support block 273.

A pin 272 passes through a pair of opposed slots 274 in the inner sleeve 268 and is secured on each end to the outer sleeve 270 (most clearly illustrated in the right-hand portion of FIG. 16). On the right-hand side of FIGS. 16 and 17, the pin 272 and receiving slot 274 are shown rotated 90 degrees from the orientation illustrated on the left-hand side of those figures.

Preferably, the inner sleeve 268 is biased to extend a predetermined amount by a compressed spring 275 which is restrained at one end by a block 276 fixed to the inside of the sleeve 268 andd at the other end by a block 278 fixed to outer sleeve 270. The spring 275 urges the block 276 and connected sleeve 266 outwardly until the ends of the slots 274 abut the pin 272 which is fixedly mounted to outer sleeve 270.

A suitable means for reciprocating the sleeve 270, such as a solenoid operator 280, is secured to block 278 through rod 282. When the solenoid actuator 280 is operated to extend the push rod 266, the rod 282 of the actuator 280 moves to the right (as viewed at the left side of FIGS. 16 and 17) forcing the block 278 and outer sleeve 270 to the right. Movement of the block 278 to the right also moves the spring 275 to the right along the sleeve 270. Owing to the compressive force of the spring 275, the inner sleeve 268 is also forced to the right to move rod 266 against the end cap.

When the end cap has been fully seated upon the fuse body end, the resistance to further movement of the plunger rod 266 is transmitted back through the sleeve 268 and block 276 to the spring 275. Since the slots 274 allow movement of the pin 272 therein, and since the pin 272 is fixed to the outer sleeve 270, the spring 275 becomes more compressed and only the outer sleeve 270 continues to move relative to the inner sleeve 268. Thus, any "overshoot" of the solenoid actuator 280 is taken up by the relative movement of the outer sleeve 270 relative to the inner sleeve 268. The amount of force that is applied to the end cap by the rod 266 is thus controlled by the amount of the spring constant of the spring 275. The force applied to the end cap can be adjusted by varying the spring constant.

Preferably, the carbon push rod 266 functions as a resistance heating element and is supplied with electrical energy (through suitable electrical connections not illustrated). When the end cap has been pushed onto the fuse body end as illustrated in FIG. 17, the rod 266 is electrically heated very rapidly and the heat is very quickly conducted into the end cap on the fuse body. This heat remelts the solid solder coating in the end cap and causes the solder to be agitated within the end cap, to flow around the bent over fuse wire end, and to form a good electrical connection between the fuse wire and the end cap. Additionally, if sufficient heat is applied for a sufficient length of time, the end of the thermoplastic fuse body will soften. After the heating of the end cap is terminated and the plunger rod 266 retracted, the solder rapidly cools and the softened thermoplastic body cools against the overlapping end cap surfaces to form a tight connection therebetween.

After the end caps have been applied at the end cap applying stations 260, the rotary holder 350 is rotated to carry the completed, end-capped fuse 10 out of the station 260 and to bring the next uncapped fuse body 10' into the station. Eventually, the completed end-capped fuse 10 is carried to the Fourth Station, at the bottom of the rotary holder 350 illustrated in FIG. 11, where the clamping member 362 is opened away from the bearing plate 360 to allow the completed fuse 10 to drop away under the influence of gravity to a suitable receiver means (not illustrated).

After releasing the completed fuse 10, the clamping member 362 remains in the open position for receiving the next uncapped fuse body from the track 320 at the First Station.

The preferred operations performed on the end caps will be next explained in detail with respect to FIGS. 10 and 12 through 15. Suitable end caps may be dumped or placed into a receiving and feed means 200, such as those manufactured by Universal Feeder, Incorporated. These include the type having a generally circular, rotatable bottom disc and a fixed cylindrical sidewall having a threaded track helically disposed thereon.

The end caps may be of any type suitable for use with the molded fuse body. Preferably, the end caps have a configuration as illustrated for end caps 16 in FIGS. 1 and 2. However, a plain cylindrical end cap (without a reduced-diameter, solder-containing reservoir adjacent the end wall) may also be used. To simplify the illustrations, the end caps 16 in the FIGS. 10 and 12 through 15 are shown as having a plain cylindrical configuration without the reduced-diameter solder reservoir.

The end caps 16 are fed by the two feeders 200 onto parallel tracks 210 and are aligned in the tracks in side-by-side relation. The further processing of the end caps 16 will be described with reference to the track 210 and attached components shown in the lower half of FIG. 10. It is to be understood that the description applies in an analogous manner to the other track 210 and attached components shown in the upper half of FIG. 10.

The feeder forces the caps along the track 210 to the solder application station 214 with each end cap supported on its end wall and with the opening of each end cap directed upwardly. The feeder 200 may be driven by any suitable means, including a transmission system connected with a main drive unit for the entire end capping apparatus.

Figures 14, 15:
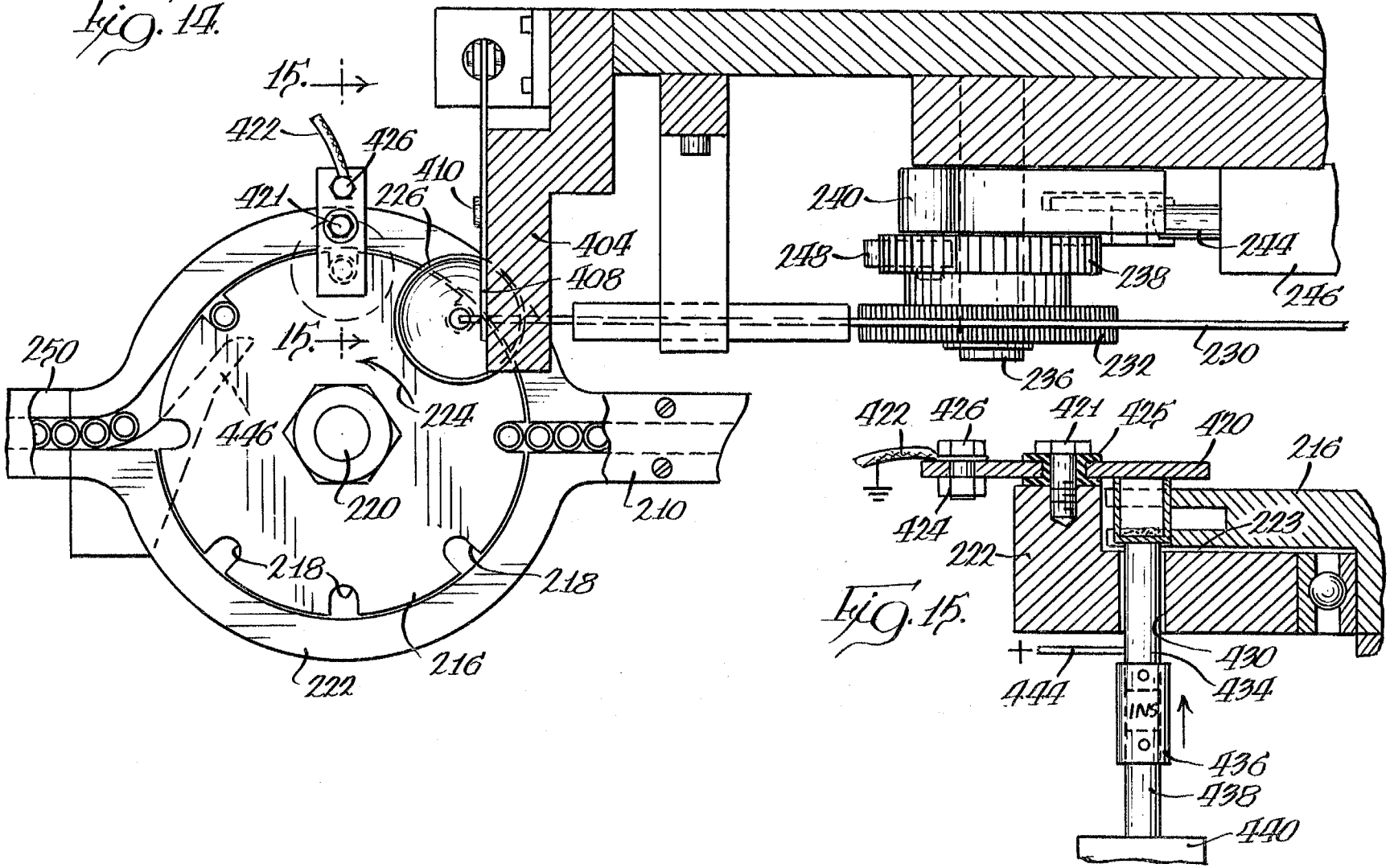
FIG. 14 is a fragmentary, cross-sectional view taken along the plane 14—14 in FIG. 12.
FIG. 15 is a cross-sectional view taken along the plane 15—15 in FIG. 14.

An end cap feed wheel 216 is provided at the solder application station 214 for receiving individual end caps and positioning them at the proper location for receiving solder. The end cap wheel 216 is best illustrated in FIG. 14 as having a series of notches 218 uniformly circumferentially spaced about its periphery. The wheel 216 is mounted for rotation to a shaft 220 within a support frame 222. The frame 222 has an upper surface 223, as illustrated in FIG. 15, for supporting the end caps 16 carried within the notches 218 of the wheel 216. The periphery of the frame 222 forms a circular wall around wheel 215 to retain the end caps within the notches of the wheel.

The end cap drive wheel 216 is intermittently rotated through a predetermined angle of rotation in a counterclockwise direction indicated by arrow 224 in FIG. 14. When one of the notches 218 is aligned with the end cap track 210, a single end cap is forced into the notch. The wheel 216 then rotates through another increment to bring the end cap within the notch beneath a funnel 226. The end cap carried within the notch is prevented from sliding out of the notch by the peripheral wall of the guide frame 222.

Figures 12, 13:
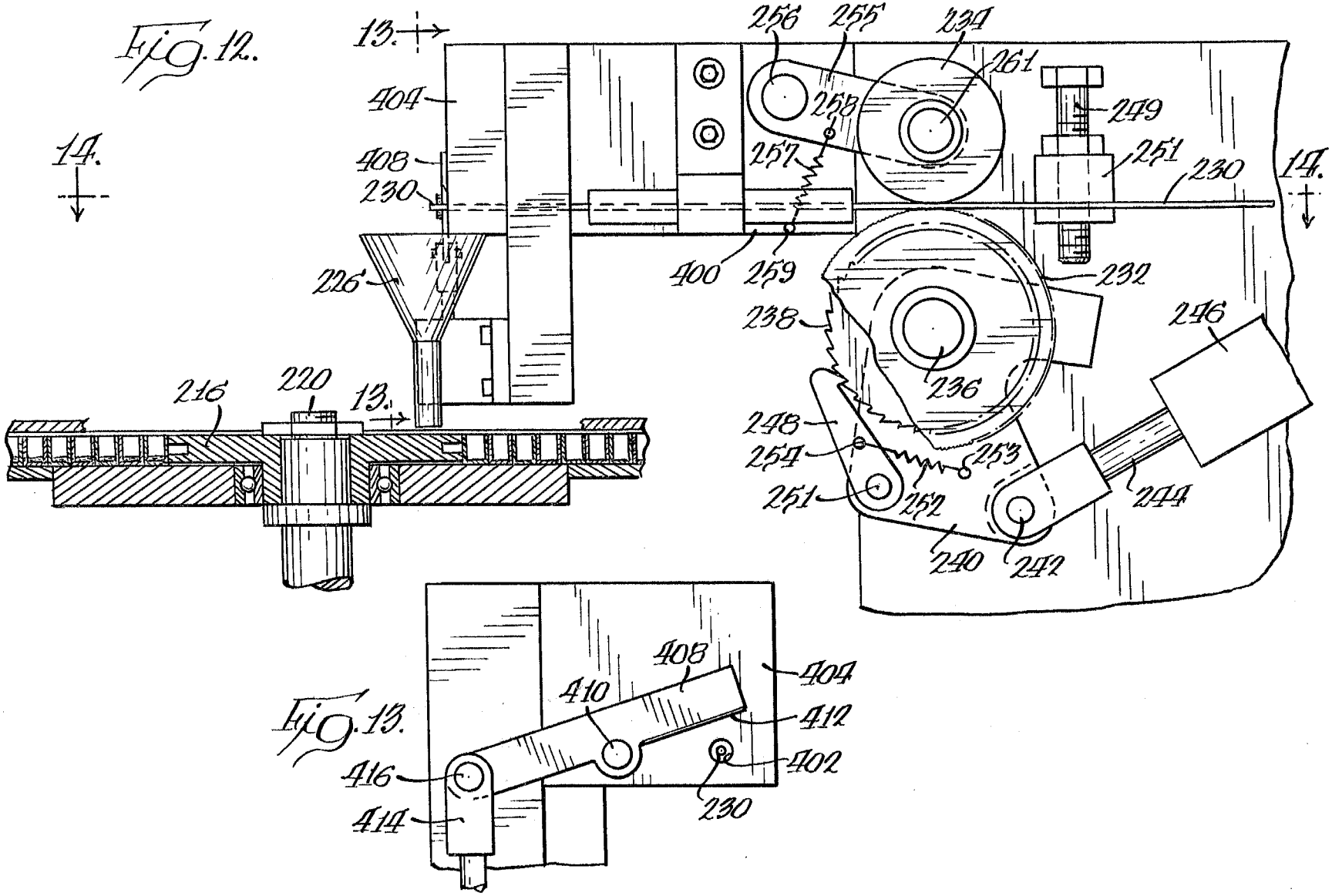
FIG. 12 is an enlarged, fragmentary, cross-sectional view taken generally along the plane 12—12 in FIG. 10.
FIG. 13 is an end view taken generally along the plane 13—13 in FIG. 12.

The funnel 226 directs a piece of solid solder into the upstanding end cap therebelow (FIGS. 12 and 14). The solder is provided by a novel mechanism as best illustrated in FIGS. 12, 13, and 14. With reference to FIG. 12, the continuous solder wire 230 is unreeled from a spool (not illustrated) located adjacent the apparatus. The solder wire 230 is driven forward over the funnel 226 a predetermined amount on an intermittent basis. To this end, the wire 230 is threaded between a drive wheel 232 and an idler wheel 234.

The drive wheel 232 is secured to a shaft 236 adjacent a ratchet wheel 238 which is also secured to the shaft 236. The shaft 236 is mounted to a suitable fixed portion or frame on the apparatus. Mounted for rotation about the shaft 236 is a swing plate 240. Swing plate 240 is pivotally connected at one end about a pin 242 to the piston rod 244 of a cylinder/piston actuator 246. The actuator 246 is pivotably mounted on a suitable frame (not illustrated).

A pawl 248 is pivotably mounted about pin 251 to the swing plate 240. The pawl is spring biased against the ratchet wheel 238 by spring 252 which is connected on one end to aperture 253 in the swing plate 240 and on the other end to aperture 254 in the pawl.

Operation of the actuator 246 in one direction extends piston 244 to move the swing plate 240 and pawl 248 upwardly along the teeth of the ratchet wheel 238. Operation of the actuator 246 in the other direction retracts piston 244 to move the pawl 248 downwardly along the ratchet wheel where the pawl 248 engages the teeth of the ratchet wheel 238 and causes the ratchet wheel 238 to rotate in a counterclockwise direction as viewed in FIG. 12, thus pushing the solder wire 230 forward. By controlling the length of reciprocating of the actuator 246, the length of solder wire 230 that is fed with each reciprocation can be adjusted. Further, a positive stop, in the form of a bolt 249 mounted in a bracket 251, may also be provided to abut the swing plate 240 and terminate the feeding of the solder wire 230.

To ensure good contact between the wire 230 and the drive wheel 232, the idler wheel 234 is mounted on shaft 261 to a pivot arm 255 which is in turn mounted about a pin 256. The arm 255 is spring-biased against the wire 230 and wheel 232 by spring 257 secured on one end through aperture 258 to the pivot arm 255 and on the other end to aperture 259 in a bracket 400.

The distal end of the wire 230 passes through a guide channel 402 in guide block 404 as best illustrated in FIGS. 12, 13, and 14. A blade 408 is mounted for rotation about a pin 410 at the front of block 404. One end of the blade 408 has a cutting edge 412 adapted to move between a raised position above the wire 230 and a lowered position below the wire 230 during the severing process. The end of the blade 408 opposite the end having the cutting edge 412 is secured to an actuating arm 414 with a pivot pin 416. The actuating arm 414 may be reciprocated intermittently in a vertical direction by any suitable drive means, such as a cylinder/piston actuator (not illustrated).

When an end cap is moved below the funnel 226 by the end cap drive wheel 216 as illustrated in FIG. 14, the solder wire 230 is fed forward a predetermined amount. Then the blade 408 is moved to sever the length of solder wire 230 projecting from the front face of block 404.

The severed portion of the solder wire falls through the funnel and into the end cap. Then, another incremental rotation of the end cap drive wheel 216 brings the end cap, with the piece of solder therein, into alignment with an overlying, upper electrode 420. The electrode 420 is mounted to the guide frame 222 by a suitable screw 421. The electrode 420 is insulated from the frame 222 by a spool-shaped insulator 425 around screw 421. The electrode 420 is connected on one end to an electrical circuit, or to ground, as through wire 422 which is clamped to the electrode 420 by nut and bolt 424 and 426, respectively.

With reference to FIG. 15, it is seen that the guide frame 222 has a bore 430 located below the electrode 420. Since the notch 218 in the end cap drive wheel 216 has no bottom wall, the end cap is free to ride on the upper surface 223 of the guide frame 222 overlying the bore 430. A lower electrode 434 is provided for entering the bore 430 and contacting the underside of the end cap within the wheel 216 below the upper electrode 420.

The lower electrode 434 is secured through an insulating coupling 436 to the piston 438 of a piston/cylinder actuator 440. The actuator 440 raises and lowers the electrode 434 within the frame 222. In the lowered position, the electrode 434 is retracted below the surface 223 of the frame 222 to allow the bottom of the end cap to be supported on the surface 223 of the frame 22.

In the raised position, the electrode 434 lifts the end cap upwardly off of the surface 223 a slight amount and brings the top edge of the end cap into contact with the upper electrode 420. Electrical power is supplied to the lower electrode 434 by suitable means, such as wire 444. Electrical power may be supplied to the electrode 434 through a conventional resistance welding circuit whereby the time period during which the electrical energy is applied is relatively short. The conductance of the electricity through the metal end cap between the two electrodes causes the end cap to heat up in a very short period of time and causes the solid piece of solder therein to melt and coat a portion of the inside of the end cap. After the solder has melted and coated a portion of the inside of the end cap, the electrode 434 is retracted to allow the end cap to be supported again on the upper surface 223 of the frame 222.

The wheel 216 is next rotated in the counterclockwise direction, as viewed in FIG. 14, to move the soldered end cap into the track 250. To this end, a guide 446 is provided inwardly of the notches adjacent the track 250 to force the end caps out of the notches and into the track 250. The end caps in the track 250 are then positively moved along the track in side-by-side relationship in an intermittent motion caused by the incremental rotation of the end cap drive wheel 216.

Each guide track 250 curves downwardly from a generally horizontal orientation illustrated in FIG. 14 to the vertical orientation illustrated in FIGS. 16 and 17 at the end cap applying stations 260. This causes each end cap to assume an orientation in which the end wall of the cap is generally vertical and in which the end cap opening is facing the respective body end of the thermoplastic fuse body retained in the rotary holder 350.

At this point the end caps are in position to be applied to the fuse body as has been described in detail above with respect to FIGS. 10, 16, and 17.

Though the method and apparatus for applying end caps in accordance with the present invention has been described in detail with respect to a fuse having a generally cylindrical body and generally cylindrical end caps, it is to be realized that non-cylindrical end caps can be applied to a non-cylindrical fuse body by the method of the present invention. Depending on the shape of the fuse body and end caps, certain modifications might have to be made to the illustrated apparatus.

Though the illustrated apparatus has been described as being used to apply solder to the inside of the end caps prior to placing the end caps on the fuse body ends, it is to be understood that fuses can be made without applying solder to the end caps. In such a case, physical contact between the end walls of the end caps and the fuse wire end portions is required to ensure a good electrical contact.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A method for making an encapsulated, end-capped fuse having (1) a body defining a body sidewall and oppositely facing body ends, said body comprising a solid unitary body of molded thermoplastic material, (2) a fuse wire extending through said body, said fuse wire having its midportion within said body and in surface-to-surface contact therewith, said fuse wire further having opposite end portions each extending outwardly beyond one end of said body, and (3) an end cap on each said body end, said method comprising:

(a) placing a fuse wire adjacent a cavity in a first mold;

(b) placing a second mold having a substantially flat wall defining a groove therein against said first mold whereby said elongate wire is maintained in said groove of said second mold across said first cavity of said first mold;

(c) injecting a fluid plastic material into the first cavity of said first mold to fill said cavity and encase a portion of said wire across said cavity and thereby form a composite structure;

(d) after letting said composite structure cool a predetermined amount, moving said second mold away from said first mold;

(e) placing a third mold having a cavity therein against said first mold to align the cavities of said first and third molds;

(f) injecting a fluid plastic material through said first cavity and through the composite structure therein into said cavity of said third mold and thereby form an encapsulated electrically conducting component; and (g) providing two end caps, each cap having a sidewall and an end wall, and then placing one cap on each said body end to form a completed fuse.

2. The method in accordance with claim 1 including the further steps, after step (f), of permitting said encapsulated, electrically conducting component to cool for a predetermined time, moving said third mold away from said first mold with said encapsulated, electrically conducting component held by, and projecting from, the cavity of said third mold, and then removing the completed, encapsulated, electrically conducting component from said third mold.

3. The method in accordance with claim 1 in which said first and third molds have a plurality of cavities, in which said second mold has a plurality of grooves and in which said step (a) includes placing a plurality of fuse wires adjacent the cavities of said first mold.

4. The method in accordance with claim 1 in which first and third molds include a plurality of cavities arranged in rows, in which said second mold includes a plurality of grooves arranged in rows, and in which step (a) includes laying a continuous fuse wire across each row of cavities of the first mold.

5. The method in accordance with claim 1 in which said second and third molds are placed in generally end-to-end alignment and are connected and fixed relative to each other and in which said step (d) of moving said second mold away from said first mold and said step (e) of placing a third mold against said first mold both include reciprocating said connected second and third molds between a first molding position wherein said second mold is aligned with said first mold to a second molding position wherein said third mold is aligned with said first mold.

6. The method in accordance with claim 1 in which step (a) includes providing a plastic material injection machine having a nozzle; in which step (a) includes providing a first mold having a movable front portion and a stationary rear portion with at least one plastic material distribution channel adapted to communicate between said nozzle and the cavity in said first mold, said first mold front portion being spring-biased outwardly away from said rear portion; and in which said step (b) of placing a second mold against said first mold includes urging said second mold against said front portion of said first mold to force said front portion of said first mold against said rear portion by overcoming the spring bias.

7. The method in accordance with claim 1 including the further steps, after step (f), permitting said encapsulated, electrically conducting component to cool for a predetermined time; moving said third mold away from said first mold with said completed encapsulated, electrically conducting component projecting from the cavity of said third mold; and then removing the encapsulated, electrically conducting component from said third mold.

8. The method in accordance with claim 1 including the further steps, after step (f), of permitting said encapsulated, electrically conducting component to cool for a predetermined time; moving said third mold away from said first mold with said completed encapsulated, electrically conducting component held by, and projecting from, the cavity of said third mold; providing a trim die fixed at one end of said first mold and presenting a trimming surface substantially coplanar with the parting line surface of said first mold; effecting relative movement between said third mold and trim die to bring said third mold and die together to sever said wire to a predetermined length on at least one end of said component.

9. The method in accordance with claim 1 in which step (a) includes providing said first mold on a rotatable turntable oriented at a first station and includes placing wire from a continuous roll of wire across a portion of said turntable and adjacent the stationary cavity in said first mold.

10. The method in accordance with claim 9 in which the step (b) of placing a second mold against said first mold includes rotating the turntable to move said first mold to a second station adjacent a second mold adapted to overlie said turntable.

11. The method in accordance with claim 10 in which step (e) of moving a third mold against said first mold includes rotating the turntable to move said first mold to a third station adjacent a third mold adapted to overlie said turntable.

12. The method in accordance with claim 11 including the further steps, after step (f), of moving said third mold away from said first mold after a predetermined period of time; rotating said turntable to move said first mold to a fourth station; and moving a trimming die against said first mold in said fourth station to sever the wire on at least one of the body ends of said component.

13. The method in accordance with claim 9 in which said first and third molds have a plurality of cavities, said cavities being aligned in a plurality of parallel rows; in which said second mold has a plurality of grooves; and in which step (a) also includes aligning a plurality of continuous wires in parallel relation across the face of said first mold.

14. A method for molding an article around an insert comprising:

(a) providing a first mold having a cavity;
(b) placing an insert in said first mold cavity;
(c) placing a second mold having a substantially flat wall against said first mold;
(d) injecting a fluid plastic material into the cavity of said first mold to fill said cavity and encase a portion of said insert and thereby form a composite structure;
(e) after letting said composite structure cool a predetermined amount, moving said second mold away from said first mold;
(f) moving a third mold having a cavity therein against said first mold to align the cavities of said first and third molds; and
(g) injecting a fluid plastic material through the material in said first mold cavity and into said cavity of said third mold to thereby form a completed article.

15. A method for making a plurality of encapsulated, end-capped fuses, each fuse having (1) a body defining a body sidewall and oppositely facing body ends, said body comprising a solid unitary body of molded thermoplastic material, (2) a fuse wire extending through said body, said wire having its midportion within said body and in surface-to-surface contact therewith, said wire further having opposite end portions each extending outwardly beyond one end of said body, and (3) an end cap on each said body end, said method comprising:

(a) providing a vertically fixed assembly of a first mold and a trim die below said first mold and fixed relative to said first mold, said first mold having a plurality of parallel rows of cavities in a front face thereof, each row being generally vertically oriented and having a plurality of cavities, said first mold further having a plurality of fluid plastic material flow channels communicating between each of said cavities in the front face of said first mold and an infeed orifice on the rear portion of said first mold;
(b) providing a vertically and horizontally reciprocable assembly of a second mold and a third mold disposed below said second mold, said second mold having a substantially flat wall defining a plurality of grooves therein arranged in parallel vertical rows and adapted to be aligned with the cavities of said first mold, said third mold having a plurality of parallel rows of cavities in the face thereof, each row being generally vertically oriented and having a plurality of cavities, said cavities adapted to be aligned with said cavities of said first mold, said reciprocable assembly having means for reciprocating said reciprocable assembly of second and third molds in a vertical direction, said reciprocable assembly having means for reciprocating said reciprocable assembly of said second and third molds in a horizontal direction against and away from said assembly of said first mold and trim die;

(c) providing a plurality of spools of wire above said first mold, said spools of wire being partially unwound to hang downwardly between said first mold and said reciprocable assembly of said second and third molds;

(d) moving said reciprocable assembly to align said second mold in a vertical direction with said second mold spaced outwardly away from said first mold and with said wires between said first and second molds;

(e) moving said reciprocable assembly horizontally against said vertically fixed assembly of said first mold and trim die whereby said plurality of wires are received within said grooves of said second mold and are forced across said cavities of said first mold;

(f) injecting a fluid plastic material into said first mold through said channels to fill said cavities of said first mold and to encase portions of said wire across each cavity in said first mold and thereby form a composite structure;

(g) after letting said composite structure cool a predetermined amount, moving said reciprocable assembly of said second and third molds away from said vertically fixed assembly of said first mold and trim die;

(h) moving said reciprocable assembly of said second and third molds vertically upwardly to align said third mold with said first mold;

(i) moving said reciprocable assembly of said second and third molds against said vertically fixed assembly of said first mold and trim die to align the cavities of said third mold with the cavities of said first mold;

(j) moving said reciprocable assembly of said second and third molds horizontally against said assembly of said first mold and trim die to align the cavities of said first and third molds;

(k) injecting a fluid plastic material through said channels in said first mold and through the partially cooled material in said cavities in said first mold to said cavities of said third mold to thereby form a plurality of encapsulated, electrically conducting components;

(l) moving said reciprocable assembly of said second and third molds away from said vertically fixed assembly of said first mold and trim die with said components held by, and projecting from, the cavities of the third mold;

(m) moving said reciprocable assembly of said second and third molds vertically downwardly to (1) align said second mold at said first mold and said third mold with said trim die and (2) pull the wire from said spools and train the wire between said second and first molds;

(n) moving said reciprocable assembly of said second and third molds horizontally towards said vertically fixed assembly of said first mold and trim die whereby the wires are severed adjacent the ends of said encapsulated electrically conducting components in said third mold;

(o) removing said components from said third mold; and (p) providing end caps each end cap having a sidewall and an end wall and then placing one cap on each end of each said component to form a plurality of completed fuses.

16. The method in accordance with claim 15 in which said first mold includes a movable cavity portion and a fixed fluid plastic material distribution channel portion, said cavity bearing portion being normally springbiased outwardly away from said channel portion and wherein said steps of moving said reciprocable assembly of said second and third molds against said assembly of said first mold and trim die include contacting the parting plane faces of said molds to urge said cavity portion of said first mold to overcome the outward bias and abut said channel portion of said first mold wherein said steps of moving said reciprocable assembly of said second and third molds away from said first mold and trim die after fluid plastic material injection includes moving said reciprocable assembly of said second and third molds far enough outwardly away from said vertically fixed assembly of said first mold and trim die to permit the plastic runner between said cavity portion of said first mold and said channel portion of said first mold to drop downwardly away from, and between said cavity and channel portions.

17. A method of applying an electrically conductive end cap to each end of a conducting component having a body defining a body sidewall and oppositely facing body ends and having a conductor element having opposite end portions each extending outwardly beyond one end of said body, said method comprising:

(a) providing a plurality of electrically conductive end caps, each end cap including a sidewall and an end wall;

(b) moving each conducting component to said end cap applying station;

(c) aligning, at said end cap applying station, two end caps and the body of a conducting component on at least one coincident longitudinal axis with the end wall of each end cap facing away from said conducting component;

(d) placing each said end cap onto one of said body ends of said conducting component and in contact with said conductor element end portion.

18. The method in accordance with claim 17 in which step (b) includes the steps of first:

(1) providing two anvil surfaces spaced apart a distance less than the distance between the distal ends of the outwardly extending conductor elements on each conducting component; and (2) sequentially moving each conducting component between said anvils and contacting the outwardly extending end portions of the conductor elements on each end of each of said bodies to bend the end portions inwardly towards the respective body ends as the conducting component is carried past the anvils.

19. The method in accordance with claim 17 in which said step (a) of providing a plurality of end caps includes the steps of sequentially moving each said end cap to a solder application station and introducing solder into each said end cap to form a solid solder deposit coating within each said end cap.

20. The method in accordance with claim 17 in which said method includes, after step (d), the further step of supplying sufficient heat to each said end cap on said component body to melt said solder coating whereby the solder is violently agitated and flows throughout the cap to bond said conductor end portion to said end cap.

21. The method in accordance with claim 18 in which said step of introducing solid solder into said end cap includes the steps of depositing a solid charge of solder into each said cap, heating each said cap to melt said solder, and then cooling said solder within each said end cap to form a solid solder deposit coating with the cap.

22. The method in accordance with claim 21 in which the step of depositing a solid charge of solder to said cap includes feeding a continuous wire of solder at an elevated position, moving said end cap below said elevated position, and then severing a portion of said continuous wire of said solder and allowing it to fall into said cap.

23. The method in accordance with claim 21 in which said step of heating said end cap includes applying heat by means of resistance heating to an exterior surface of said end cap.

24. The method in accordance with claim 21 in which said step of depositing solder includes maintaining said end cap in a generally vertical position with said end wall lower than other portions of the end cap.

25. The method in accordance with claim 20 in which said further step of applying sufficient heat to each said end cap on said component body includes applying heat by means of resistance heating to an exterior surface of said end cap.

26. The method in accordance with claim 20 in which said step (d) of placing an end cap onto one of said body ends includes forcing the end wall of said end cap against the bent over end portion of said conducting element to force the bent over end portion of said conducting element further towards said conducting component body end.

27. The method in accordance with claim 17 in which step (d) includes substantially simultaneously placing two end caps on the conductor component body, one end cap on each end of the body.

28. The method in accordance with claim 25 in which said further step of applying sufficient heat to each said end cap on said component body includes applying heat to the end cap on each end of said component substantially simultaneously.

29. The method in accordance with claim 18 in which said steps of moving each said conducting component body past two spaced apart anvils and to an end cap receiving station include sequentially holding each said conducting component body on a rotating holder and rotating the holder to carry the conducting component thereon past said anvils to said end cap receiving station.

30. An apparatus for applying end caps each having a sidewall and an end wall to a partially fabricated fuse body of molded thermoplastic material with a body sidewall and oppositely facing body ends, said apparatus comprising:

track means for receiving said end caps in side-by-side relation, said track having a terminus at and end cap applying station including a stop member against which said end caps are forced, said track defining an aperture adjacent said stop member to expose the end wall of an end cap when the end cap abuts said stop member;

means for feeding said end caps into said track and forcing said end caps along said track;

means for moving said partially fabricated fuse adjacent said track with at least one of said body ends of said partially fabricated fuse adjacent the terminus of said track whereby an end cap which is abutting said stop member is aligned with said fuse body end; and reciprocating plunger means for entering said track aperture and forcing one of said end caps outwardly from said track onto a body end of said partially fabricated fuse.

31. The apparatus in accordance with claim 30 further including:

means for feeding a continuous length of solder wire;

means for intermittently severing segments from said continuous length of solder wire; and funnel means for directing said severed segments of solder wire into said end caps supported in said tracks.

32. The method in accordance with claim 30 further including:

means adjacent said track for depositing a piece of solid solder in one of said end caps;

electrode means adjacent said track for contacting one of said caps containing solid solder and passing electric current through the cap to melt the solder.

33. The method in accordance with claim 32 further including means for heating said reciprocating plunger when in contact with said end cap on said body end to remelt said solder.

34. An apparatus for applying end caps to a partially fabricated fuse body of molded thermoplastic material about a fuse wire with opposite end portions of said wire each extending outwardly beyond one end of said body, said apparatus comprising:

two anvil surfaces spaced apart a distance less than the distance between the distal ends of the outwardly extending fuse wire end portions on the fuse body;

means for moving one of said partially fabricated fuse bodies in a direction generally perpendicular to the length of said fuse wire in said body and past said two opposed anvil surfaces to cause said end portions of said fuse wire to be bent inwardly towards said body ends of said partially fabricated fuse and then moving said fuse body to an end cap applying station; and means at said end cap applying station for placing an end cap on each of said body ends of said partially fabricated fuse.

* * * * *

UNITED STATES PATENT AND TRADEMARK OFFICE

CERTIFICATE OF CORRECTION

PATENT NO. : 4,205,431

DATED : June 3, 1980

INVENTOR(S) : Gerald L. Wiebe

It is certified that error appears in the above—identified patent and that said Letters Patent is hereby corrected as shown below:

Column 1, line 55, "mode" should read -- mold --.

Column 7, line 18, "33 5/8" should read -- 33 1/3 --.

Column 8, line 60, insert "end" before "walls ".

Column 15, line 9, "20" should read -- 120 --.

Column 16, line 20, "38" should read -- 138 --.

Column 19, line 66, "fo" should read -- to --.

Column 20, line 16, "andd" should read -- and --.

Signed and Sealed this

Ninth Day of June 1981

[SEAL]

Attest:

RENE D. TEGTMEYER

Attesting Officer

Acting Commissioner of Patents and Trademarks